US007892400B2

(12) United States Patent
Sabourin

(10) Patent No.: US 7,892,400 B2
(45) Date of Patent: Feb. 22, 2011

(54) HIGH DEFIBERIZATION CHIP PRETREATMENT APPARATUS

(75) Inventor: Marc J. Sabourin, Huber Heights, OH (US)

(73) Assignee: Andritz Inc., Muncy, PA (US)

( * ) Notice: Subject to any disclaimer, the term of this patent is extended or adjusted under 35 U.S.C. 154(b) by 389 days.

(21) Appl. No.: 11/985,928

(22) Filed: Nov. 19, 2007

(65) Prior Publication Data

US 2008/0142181 A1 Jun. 19, 2008

Related U.S. Application Data

(63) Continuation of application No. 10/485,916, filed as application No. PCT/US03/22057 on Jul. 16, 2003, now Pat. No. 7,300,541.

(60) Provisional application No. 60/397,153, filed on Jul. 19, 2002.

(51) Int. Cl.
*D21F 1/14* (2006.01)

(52) U.S. Cl. ..... 162/261

(58) Field of Classification Search ..... 162/17–19, 162/23–25, 28, 261; 241/28, 544, 261.2, 241/26, 56, 68

See application file for complete search history.

(56) References Cited

U.S. PATENT DOCUMENTS 2,396,587 A * 3/1946 Lowgren et al. ..... 162/236
3,802,630 A 4/1974 Lee et al. ..... 241/18
4,269,365 A * 5/1981 Berggren ..... 241/152.2

(Continued)

FOREIGN PATENT DOCUMENTS

EP 0 172 135 A1 2/1986

(Continued)

OTHER PUBLICATIONS

Knovel Steam Tables, Table 1a, Saturation Properties vs Temperature—SI Units, 2006 [online]. Retrieved from the Internet: <http://knovel.com/web/portal/browse/display?_EXT_KNOVEL_DISPLAY_bookid=1251&VerticalID=0> [retrieved on Nov. 12, 2009].*

(Continued)

*Primary Examiner*—Eric Hug
(74) *Attorney, Agent, or Firm*—Alix, Yale & Ristas, LLP

(57) ABSTRACT

A chip pretreatment process which comprises conveying the feed material through a compression screw device having an atmosphere of saturated steam at a pressure above about 5 psig, decompressing and discharging the compressed material from the screw device into a decompression region, feeding the decompressed material from the decompression region into a fiberizing device, such as a low intensity disc refiner, where at least about 30 percent of the fiber bundles and fibers are axially separated, without substantial fibrillation of the fibers. In a more specific form the invention is directed to a process for producing mechanical pulp, including the steps of fiberizing wood chip feed material in a low intensity disc refiner until at least about 30 percent of the fibers are axially separated with less than about 5 percent fibrillation, and subsequently refining the fiberized material in a high intensity disc refiner until at least about 90 percent of the fibers are fibrillated. In another form the invention combines chip fiberizing with chemical treatments, for improving the pulp property versus energy relationships.

19 Claims, 21 Drawing Sheets

U.S. PATENT DOCUMENTS

| | | | | | |
|---|---|---|---|---|---|
| 4,283,252 | A | * | 8/1981 | Reinhall | 162/23 |
| 4,286,512 | A | * | 9/1981 | Berggren | 100/74 |
| 4,298,425 | A | | 11/1981 | Ranzen et al. | 162/18 |
| 4,372,810 | A | * | 2/1983 | Bystedt | 162/23 |
| 4,684,073 | A | * | 8/1987 | Berggren | 241/247 |
| 4,954,221 | A | * | 9/1990 | Reinhall et al. | 162/261 |
| 4,986,480 | A | | 1/1991 | Gullichsen et al. | 241/28 |
| 5,335,865 | A | | 8/1994 | Kohler et al. | 241/28 |
| 5,540,392 | A | | 7/1996 | Broderick et al. | 241/28 |
| 5,776,305 | A | | 7/1998 | Sabourin | 162/23 |
| 6,073,865 | A | * | 6/2000 | Kriebel et al. | 241/18 |
| 6,267,841 | B1 | | 7/2001 | Burton | 162/24 |
| 6,336,602 | B1 | | 1/2002 | Miles | 241/28 |
| 6,938,843 | B2 | | 9/2005 | Johansson | 241/21 |
| 2001/0050151 | A1 | | 12/2001 | Sabourin | 162/19 |

FOREIGN PATENT DOCUMENTS

| | | |
|---|---|---|
| GB | 1 266 898 | 3/1969 |
| WO | WO 94/16139 | 7/1994 |

OTHER PUBLICATIONS

Knovel Steam Tables, Table 1b, Saturation Properties vs Temperature—English Units, 2006 [online]. Retrieved from the Internet: <http://knovel.com/web/portal/browse/display?_EXT_KNOVEL_DISPLAY_bookid=1251&VerticalID=0> [retrieved on Nov. 12, 2009].*

John R. Lavigne, Pulp & Paper Dictionary, 1986, Miller Freeman Publication, p. 353.

Papermaking Science and Technology, Book 5, Mechanical Pulping, dated 1999, pp. 397-398.

* cited by examiner

HIGH DEFIBERIZATION CHIP PRETREATMENT APPARATUS

RELATED APPLICATION

This application is a continuation of, and claims priority from, U.S. patent application Ser. No. 10/485,916 filed Feb. 5, 2004 which is the U.S. national phase of International Application PCT/US03/22057, filed Jul. 16, 2003, which claims priority under 35 U.S.C. Sec. 119(e) from U.S. App. No. 60/397,153 filed Jul. 19, 2002, the disclosures of which are incorporated by reference.

BACKGROUND OF THE INVENTION

The present invention relates to the production of papermaking pulp from wood chip feed material, and particularly to mechanical refining and chemi-mechanical refining.

Efforts have been ongoing for decades to improve mechanical refining techniques (including chemi-mechanical refining) for producing papermaking pulp from wood chip feed material with decreasing specific energy requirements. A significant advance toward this objective was achieved by the present inventor in the mid 1990's, by the development of the "RTS" process, as described in U.S. Pat. No. 5,776,305, granted on Jul. 7, 1998, for "Low-Resident, High-Temperature, High-Speed Chip Refining. This development was directed to the relationship between chip pre-heat environment and high consistency primary refiner conditions, whereby a window of pre-heat residence time, pre-heat saturated steam temperature (pressure) and high disc refining speed produced a noteworthy reduction in specific energy required to achieve commercial strength properties, while retaining satisfactory optical properties.

A significant further development by the present inventor is the "RT Pressafiner" pretreatment, upstream of preheating and primary refining, as described in International Patent Application No. PCT/US98/14710, filed Jul. 16, 1998, for "Method of Pretreating Lignocellulose-Containing Feed Material". According to the RT Pressafiner development, chip feed material received, for example, from an atmospheric pre-steaming bin, is first conditioned at elevated temperature and pressure for a controlled period of time, and then highly compressed at elevated temperature and pressure, whereupon the pretreated chips may be conveyed directly into the preheater portion of a primary refiner, or retained in an atmospheric bin until subsequent feeding to the preheater of a primary refiner.

The combination of the RT Pressafiner pretreatment with the RTS primary refining, produces an exceptionally energy efficient mechanical refining system, due largely to the significant extent of axial separation of the fibers in the chips fed to the primary refiner. Although the RT Pressafiner pretreatment method and apparatus has been highly effective in producing axially separated fibers (i.e., separated along the grain), there appears to be an upper limit on axial separation of about 25-30 percent of the total chip mass.

SUMMARY OF THE INVENTION

It is thus an object of the present invention to provide apparatus and method for producing at least about 30 percent axially separated fibers in the chip feed material during pretreatment upstream of the preheating section of a mechanical refining system.

It is a further object that this high degree of axially separated fibers be achieved while retaining the benefits of the apparatus and method described in International Application PCT/US98/14710, i.e., maceration of chip structure with minimal damage under pressurized inlet conditions, reduction in refiner energy consumption, good extractives removal, improved chip size distribution for refiner stability, and improved impregnation of chemicals, while achieving significant further reduction in required specific energy for producing satisfactory quality papermaking pulp.

This object is achieved in a chip pretreatment process which comprises conveying the feed material through a compression screw device having an atmosphere of saturated steam at a pressure above about 5 psig, decompressing and discharging the compressed material from the screw device into a decompression region, feeding the decompressed material from the decompression region into a fiberizing device, such as a low intensity disc refiner, where at least about 30 percent of the fiber bundles and fibers are axially separated, without substantial fibrillation of the fibers.

In a more specific form the invention is directed to a process for producing mechanical pulp, including the steps of defibrating or fiberizing wood chip feed material in a low intensity disc refiner until at least about 30 percent of the fibers are axially separated with less than about 5 percent fibrillation, and subsequently refining the fibrated material in a high intensity disc refiner until at least about 90 percent of the fibers are fibrillated.

The preferred apparatus for pretreating wood chips according to the invention, includes a pressure housing having an inlet end and a discharge end, a screw press formed in the housing such that the screw press receives material from the housing inlet and advances the material along a rotating screw shaft to compress the material, and a fiberizing device such as a mechanical refiner rotor, optionally within the same housing, which receives material from the screw press and fiberizes the material. Preferably, the screw shaft is axially aligned with the rotor shaft and the screw shaft rotates at a lower speed than the rotor shaft. For example, the screw shaft can rotate at a speed in the range of about 70-100 rpm with the rotor shaft operating at a speed in the range of about 800-1800 rpm.

In an alternative embodiment, the screw shaft and the rotor shaft need not be coaxial, or even in the same horizontal plane. Moreover, the screw and the rotor can be in distinct housings, such that the chips in the decompression region are directed through a chute or the like or conveyed into the inlet of the fiberizing refiner.

Preferably, the single or plural housings are maintained at a saturated steam pressure in the range of about 5-30 psig.

The material discharged from the fiberizing device has, in effect, been "resized" from chips to short, grass-like strands that have been separated along their grain axes into smaller fibrous particles.

It can be appreciated that, although the use of a pressurized pretreatment device, such as a pressurized screw, is known from the RT Pressafiner method, and certainly fibrillating chip material in a primary or secondary refiner is known, a novel and significant aspect of the present invention is the inter-positioning of a highly effective but low energy consuming fiberizing device in the pretreatment process, e.g., in the form of a mechanical refiner, which achieves high fibration without expending the energy required for substantial fibrillation. A premise of the invention is to maximize separation of the fibration and fibrillation steps of the thermomechanical refining process. The latter step is the most energy consuming, and requires efficient energy transfer at high intensity conditions to minimize total energy consumption.

The present invention is highly effective in achieving energy reduction. If one ultimately desires essentially 100 percent fibrillation via conventional mechanical refining, and the feed material is pretreated according to the known, e.g., RT Pressafiner method, the primary mechanical refining must first fiberize the chip material and then initiate fibrillation of the fibers, using design parameters that are especially adapted for the more difficult fibrillation of the fibers. With the present invention, well over 30% of the fibers, and in most instances, at least about 75% of the fibers, are axially separated (fiberized) with, preferably, a low intensity refiner or the like that is highly efficient in fiberizing (but not fibrillating). The fiberized material thus has no measurable freeness. When the fiberized material is then processed by the high intensity refiner, the higher intensity (and thus high energy level) is not wasted on the fiberizing, but rather can all be directed to fibrillating the fibers.

The present invention achieves a much higher level of axial fiber separation as compared with conventional chip presses, even as improved by the RT Pressafiner pretreatment. Fiberizing in a pretreatment fiberizing device permits fiber orientation while the fibers experience the stress-strain cycles necessary to axially separate the fibers. Pressurization permits chip size reduction in the pressing and fiberizing zones with minimal damage to the chip structure. There is a gradual transition from the pressing zone to primary refining, and this achieves axial fiber separation in a controlled manner. Moreover, higher levels of extractive removal can be achieved due to both the pressurized environment and a reduced size distribution. Furthermore, water or chemical liquor impregnation is improved.

Primary refining (fibrillating) in the production subsystem is improved, in that significantly lower specific energy is required for a given freeness, due to the high level of axially separated fibers feeding the primary refiner. This permits the lowest installed energy requirement for a given plant capacity. Moreover, increased primary refiner capacity can result from higher available plate surface area, i.e., the breaker bar zone can be substantially reduced or eliminated because a fiber material rather than chip material is sent to the primary refiner. In addition, the primary refiner load stability is improved due to the reduction in the bulk density of the feed material. The pulp property/specific energy relationships can be adjusted by the level of chip fibration achieved in the pretreatment. Finally, the parameter windows for the RTS primary refining process can be further adjusted to optimize refining for fibrated inlet material rather than merely size reduced or intact wood chips.

In general, the present invention may be alternatively formulated to comprise, consist of, or consist essentially of, any appropriate steps or components herein disclosed. The present invention may additionally, or alternatively, be formulated so as to be devoid, or substantially free, of any steps, components, materials, ingredients or species used in the prior art compositions or that are otherwise not necessary to the achievement of the function and/or objectives of the present invention.

BRIEF DESCRIPTION OF THE DRAWINGS

The preferred embodiments will be described below with reference to the accompanying drawings, in which.

DESCRIPTION OF THE PREFERRED EMBODIMENT

Figure 1:
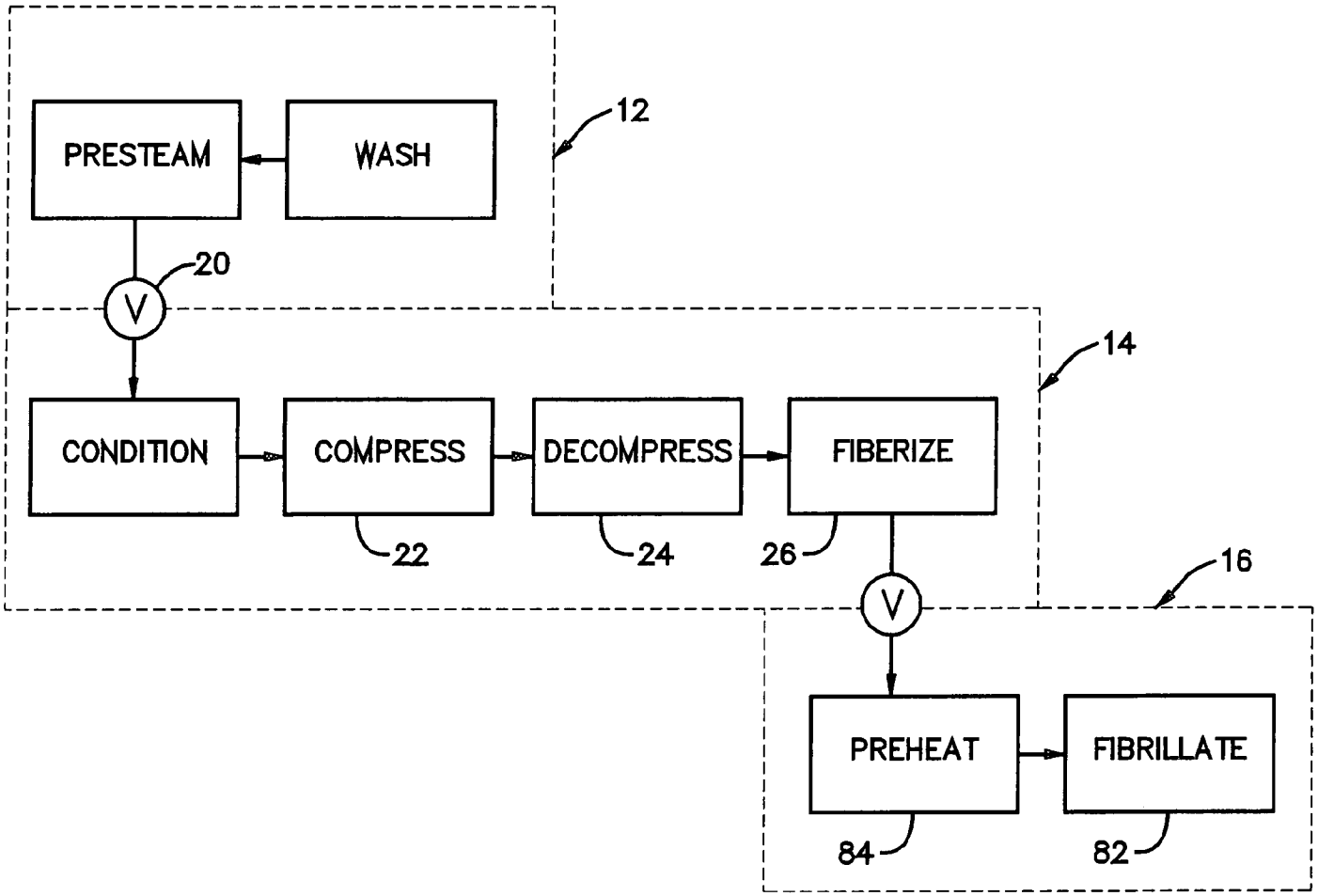
FIG. 1 is a schematic representation of a mechanical (including chemi-mechanical) refining system including preprocessing, pretreatment, and production subsystems, showing the pretreatment subsystem having conditioning, compression, decompression, and fiberizing functionality according to the invention.

FIG. 1 shows a mechanical refining system 10 (which for purposes of the present disclosure includes chemi-mechanical systems) having three major subsystems: Preprocessing 12, Pretreatment 14, and Production or Primary Refining 16.

The preprocessing subsystem 12 is conventional, in that a feed material comprising wood chips is washed then maintained in a pre-streaming bin or the like at atmospheric conditions for a period of time typically in the range of 10 minutes to 1 hour before being conveyed to the pretreatment subsystem 14.

The pretreatment subsystem 14 according to the invention, includes a pressurized rotary valve 20, for maintaining pressure separation between the preprocessing subsystem 12 and the balance of the pretreatment subsystem 14, a pressurized compression device 22, such as a screw press, a decompression zone or decompression region 24 which may be part of the screw press or connected to the discharge of the screw press, and a fiberizing device 26, such as a disc or conical refiner.

Figure 2:
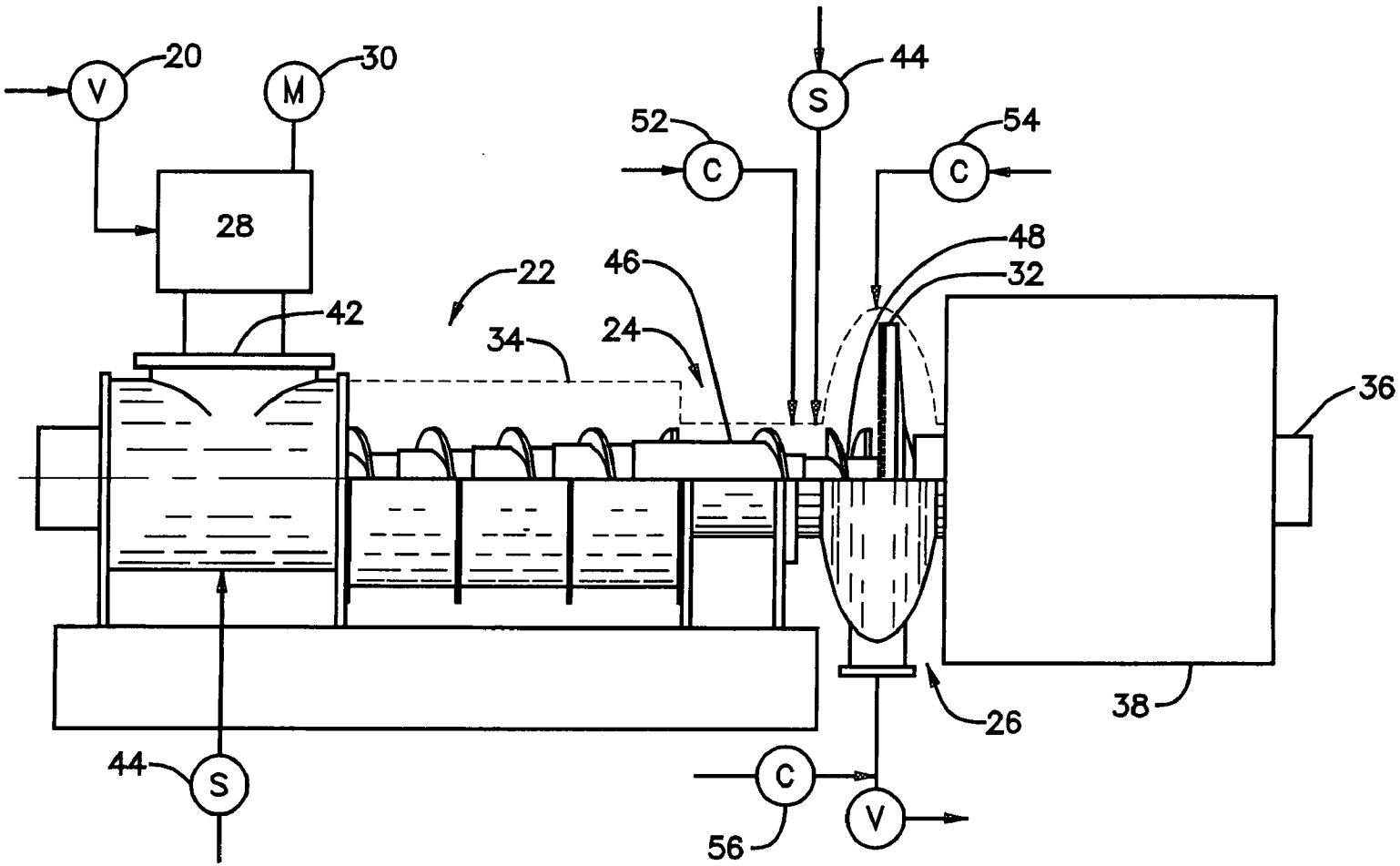
FIG. 2 is a stylized illustration of a pretreatment subsystem apparatus according to one embodiment of the invention, wherein a screw press and disc refiner rotate on a common axis.

According to the preferred embodiment of the invention, the environment within the compression device 22, the decompression zone 24, and the fiberizer 26 are all maintained at a saturated steam atmosphere in the range of about 5-30 psig. However, as a minimum, the compression device 22 operates in this environment. Preferably, as shown in FIG. 2, a transfer screw 28 is interposed between the pressurized rotary valve 20 and the compression device 22, powered by a variable speed motor 30, whereby the time period during which the chips in the transfer screw 28 are exposed to the elevated pressure and temperature conditions, before entering the screw press 22, can be controlled. As a minimum, the chips should be conditioned for a period of 5 seconds in a saturated steam atmosphere at 5 psig pressure.

For purposes of the present invention, it should be understood that, the chips would experience a volumetric compression in the ratio of about 2:1 to about 4:1 in the compression device 22. This increase in feed material density is then rapidly reversed by decompression in the decompression zone 24 which refers to release of chips at the discharge with a reduction in feed material density approaching the density of the feed material prior to entering the pretreatment subsystem 14.

FIG. 2 shows an embodiment of the invention in which the compression device 22, the decompression region 24, and the fiberizing refiner 26 are configured within a single pressure housing 34. The screw press 22 and fiberizing rotor 32 rotate coaxially about a common shaft 36 that is driven by a single motor 38. The pressurized rotary valve 20 receives presteamed chips at atmospheric pressure, and discharges the chips into an environment of elevated temperature and pressure that is present in the transfer screw 28, the housing of the compression device 34, the decompression region 24, and the fiberizing device 26. The transfer screw 28 operates at a variable speed whereby the chips, prior to entry into the inlet 42 of the screw press 22, are exposed to the elevated temperature and environment for a variable retention time. The temperature and pressure are controlled by steam pressure regulation 44 at one or both of the inlets to the screw press and the fiberizer casing. In the embodiment illustrated in FIG. 2, there is no impediment to fluid flow from the inlet 42 to the screw press 22, through the decompression region 24, and the refiner casing 26, except that, as a practical matter, the compression of the chip material immediately upstream of the discharge of the screw press can be a barrier to steam flow in the axial direction and, accordingly, it is preferable to provide a controlled source of steam on both sides of this region and thus maintain the desired temperature conditions within the housing 34.

In the embodiment of FIG. 2, the energy applied to the screw press 22 and the fiberizer 24 are closely linked to each other due to the screw press shaft and the refiner shaft being mechanically linked in close proximity for rotation at the same fiberizing speeds. The shaft rotation speed can be variable for optimizing the process relative to the production subsystem.

In the embodiment shown in FIG. 2, the decompression region 24 is substantially cylindrical and forms both the discharge of the screw press and the inlet to the refiner 26. The screw press 22 has an axial extension 46 toward the refiner 26, and the refiner shaft has an axial extension 48 toward the screw press, where the shafts are inter-engaged for relative rotation at different speeds. It can be appreciated, that the chip material, having been highly compressed in the compression zone of the screw press 22, discharges into a larger available volume and quickly expands therein, where it is conveyed by flights in the decompression region 24 such that, the decompression region also serves as the inlet for the refiner 26. In FIG. 2, the extension portion of the screw shaft 46 is flighted and the extension portion of the refiner shaft 48 is flighted, to maintain a continuous flow of short time duration of the material from the decompression zone 24 into the refiner 26.

With reference again to FIG. 2, as an optional embodiment, chemical liquors such as alkaline peroxide, sulfite, and the like that are well known, can be introduced into the decompression region at the discharge 52 of the screw press 22, at the inlet 54 of the fiberizer refiner 26, or at the discharge 56 of the fiberizer refiner 26.

Preferably, the chip feed material is fed to the compression screw 22 at a consistency in the range of about 30-50%, the decompressed chips are fed to the defibrating device 26 at a consistency in the range of about 30-50%, and the material is fiberized at a consistency in the range of about 30-40%.

Figure 3:
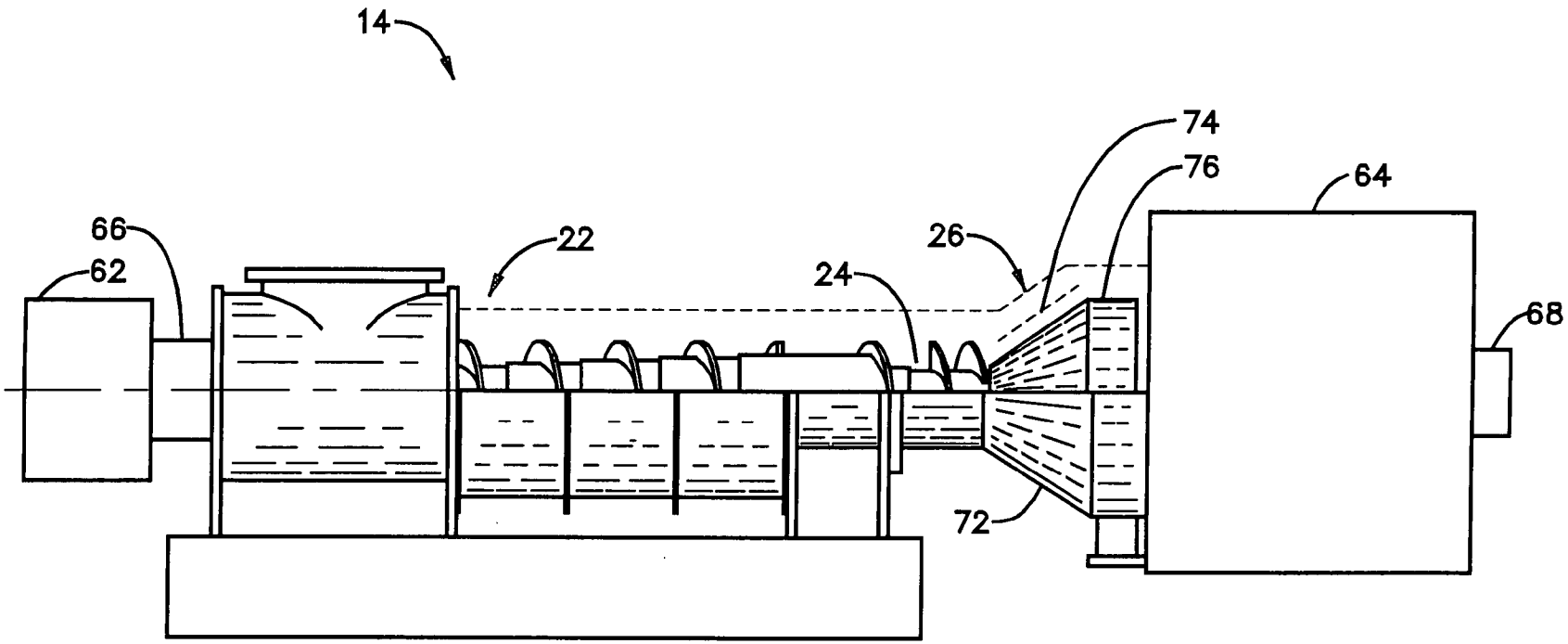
FIG. 3 is a stylized illustration of another embodiment of the invention, wherein the screw press and a conical refiner are arranged coaxially, but each has a respective drive motor or gearing that permit different rotation speeds.

FIG. 3 shows another embodiment of the pretreatment subsystem 14 wherein a separate motor 62 is provided for the screw press 22, and a respective separate motor 64 for the fiberizer refiner 26, such that the shafts 66, 68 rotate at different speeds, and optionally with varying speed ratios. For example, the screw rotation speed can be in the range of about 70-100 rpm, whereas the fiberizer rotation speed preferably has a speed in the range of about 800-1800 rpm. FIG. 3 also shows the fiberizing device 26 in the form of a conical refiner wherein the housing includes a refiner casing 72 that has a generally conical portion with a stationary plate defining one refining surface, and the rotating member 76 also has a conical section with plate confronting the stationary plate, thereby defining a conical refining gap therebetween.

It should be appreciated that a variety of disc refiners and conical refiners are well known in the field of both low and high intensity mechanical refining and that the further details regarding the orientation of the opposed refining surfaces, and the pattern of bars, grooves, or the surface irregularities formed thereon, may be selected according to known parameters. However, further development of the present invention with a focus on determining subtle relationships between the fiberizing conditions and the compression screw, or between the fiberizer and the primary refiner, may lead to the discovery of especially effective refiner fiberizing characteristics which are not presently known to the inventor.

Figure 4B:
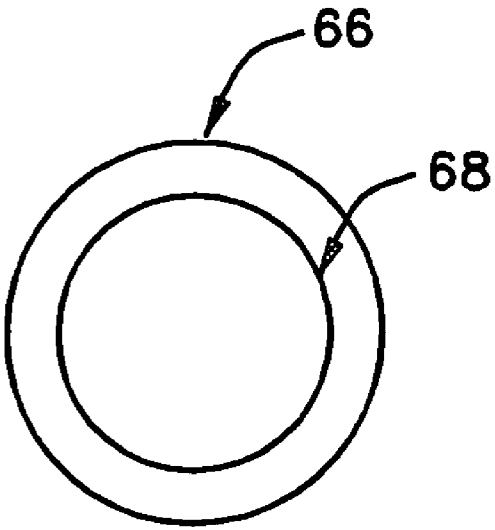
FIGS. 4*a* and 4*b* show schematically how the shaft of the screw press and the shaft of the disk refiner are preferably inter-engaged for implementing the embodiment shown in FIG. 3.
Figure 4A:
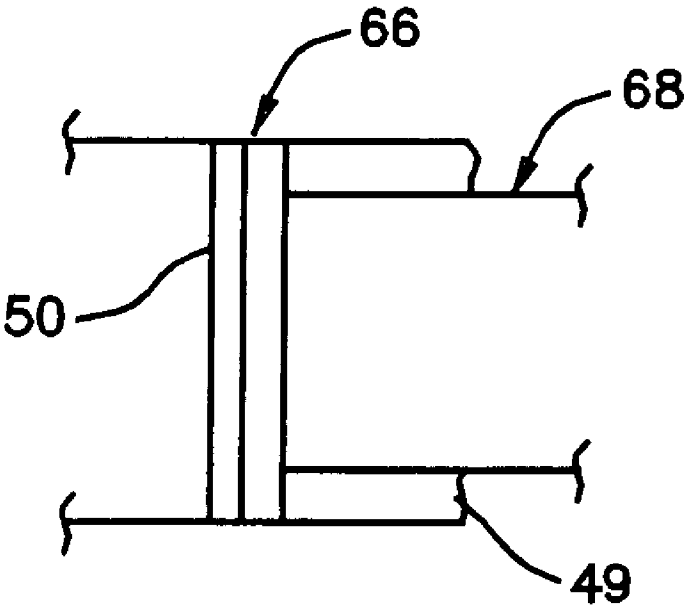

FIGS. 4*a* and 4*b* provide a schematic of one technique for the screw shaft 66 extension and the refiner rotor shaft 66 extension to inter-engage and both support each other via a bearing 50 and seal 49 in the decompression zone 24, and permit different relative rotation speeds.

Figure 5:
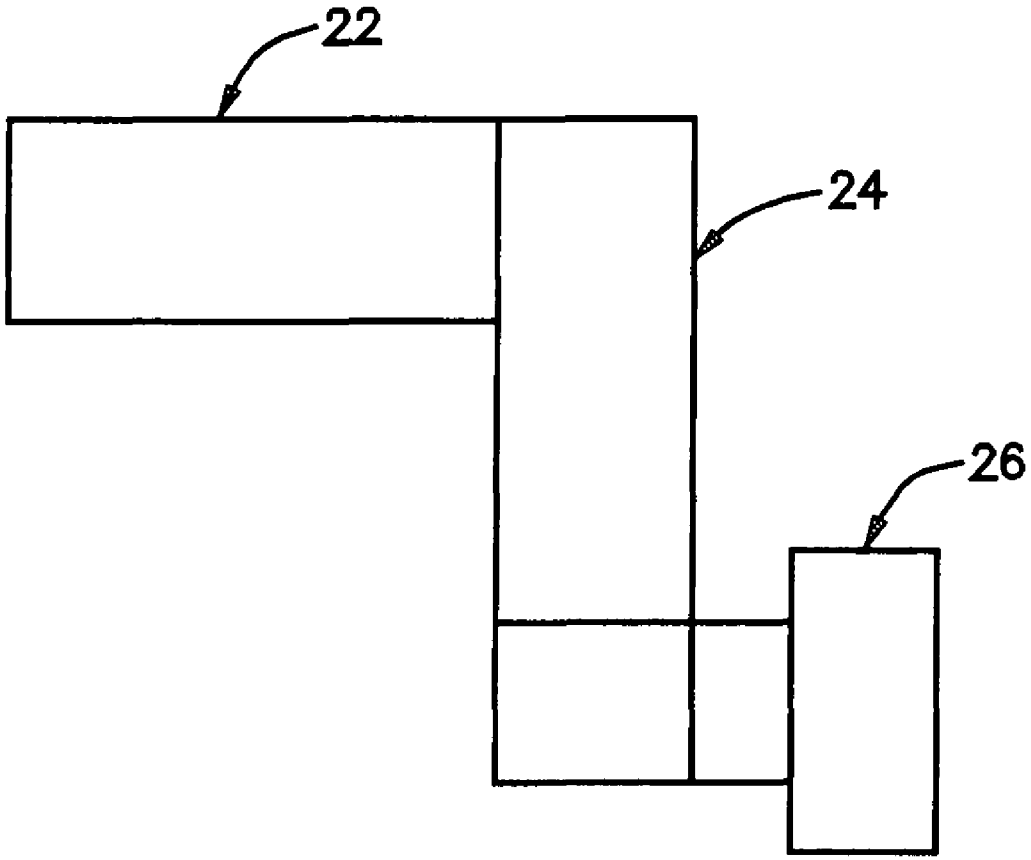
FIG. 5 is a schematic illustration of a third embodiment, wherein the screw shaft axis and the disk refiner shaft axis are not co-planar.

FIG. 5 illustrates another embodiment, wherein the rotation axis of the screw press 22 and the rotation axis of the fiberizer 26 rotor are not co-planer. In this embodiment, the decompression region 24 performs the same functions as described with respect to FIGS. 2 and 3, in that the chips as discharged from the screw press 22 expand quickly and immediately after such expansion, the chips are conveyed to the inlet of the fiberizer refiner 26. However, in this case the chips can fall vertically or obliquely with the decompression region 24 acting in part as a chute to the feed screw or flights for the refiner 26. Particularly in this embodiment, the screw press 22 and the refiner 26 need not be within the same housing. Although the embodiments of FIGS. 2 and 3 would likely occupy the minimum floor space in a mill, the embodiment of FIG. 5 may have advantages related to maintenance of operation or in a retrofit situation where any available space between preprocessing 12 and production refining 16 was not designed with the inventive pretreatment equipment in mind.

The embodiment of FIG. 5 also could be utilized for maintaining different pressures in the screw press 22 and in the fiberizing refiner 26. Moreover, for some situations, it may be desirable to operate the fiberizing refiner 26 at an atmospheric, i.e., unpressurized, condition, with or without chemical addition.

It is further well known that, for a disc refiner, the feed material is conveyed axially to the center of the disc, or "eye" where the material is then redirected radially outward through the space between vertical, or substantially vertical discs. For conical refiners, the material is merely conveyed to the "apex" of the cone, where it can readily follow the oblique path defined by the increasing diameter of the conical section.

Designers of mechanical refining systems can readily implement the various embodiments of the inventive pretreatment subsystem with known technology for the options of one or plural housings, one or plural drive shafts (whether or not connected to each other), one or plural drive motors, and/or one or plural pressures.

The essence of the invention is that the chip material upstream of the primary refiner 82, is defibrated or fiberized without substantial fibrillation. In this context, fiberizing refers to the condition in which fiber bundles (shives) and fibers are axially separated, but not enough energy is transferred to peel off fiber wall material. The removal of fiber wall material is referred to as fibrillation. According to the invention, the early wood and late wood components absorb energy (mostly early wood during the initial stages of refining), and the energy absorbed is sufficient for initiating axial separation of the wood fibers, but insufficient for any appreciable peeling of fiber wall material.

Thus, according to the invention, the chip material is fiberized to the extent that at least 30 percent, typically in the range of about 40-90 percent, of the fiber bundles and fibers are axially separated, with no or very little (i.e., less than about 5 percent) fibrillation.

Such fiberizing without fibrillation is preferably achieved in a low intensity refiner 26, which is commonly understood in the industry as referring to disc rotation speeds of no greater than 1800 rpm for single disc and no greater than 1500 rpm for double disc refiners and about 800 to no greater than 1800 rpm for conical refiners. Qualitatively, intensity is a consequence of the energy imparted to the fiber per impact with a bar structure on the plate in the refining zone. Such energy is typically defined theoretically in units of GJ/t per impact, but a number of other parameters come into play. For present purposes, the above disc refining speeds or a specific energy between about 100-200 kWh/MT will be sufficient indicators of low intensity refining. An extruder screw device may also be suitable for fiberizing chip material without substantial fibrillation.

The degree of fiber separation, and the degree of fibrillation, can be measured by microscopic analysis, such as optical or scanning electron microscopy (SEM) in a manner well known in this field of technology.

Referring again to FIG. 1, following the pretreatment subsystem 14, the pretreated chips are conveyed to the primary refining or production subsystem 16 that can optionally include an atmospheric storage bin for the pretreated chips. Whether conveyed directly from the pretreatment subsystem 14 or from the storage bin, the pretreated chips are conveyed to a preheater 84 where the chips are exposed to an atmosphere of steam at elevated temperature and pressure for a specified time period, and then introduced into the inlet of a high consistency, high intensity refiner 82, i.e., operating at a disc speed greater than 1800 rpm for a single disc refiner and greater than 1500 rpm for a double disc refiner or imparting a specific energy of at least about 800 kWh/MT. This primary refiner 82 fibrillates the material into pulp, i.e., the fibers are peeled and fiber wall material is unraveled. Fiberizing of the wood chip feed material during pretreatment 14 under gentle conditions of low intensity results in a higher percentage of intact fibers feeding the primary refining process 16. This can result in pulp of higher final long fiber content and tear index. Optimally, a secondary refiner subsequent to the primary refiner (not shown) continues unraveling or peeling of fiber wall material until desired pulp properties are obtained. In certain situations, sufficient pulp properties are achieved following one step of primary refining.

As noted previously, immediately before the discharge of the screw press 22, a very high density of wood chip feed material is formed in the restricted annulus and this can form a plug which establishes a barrier between the compression screw 22 and the discharge region 24 which is not only impermeable to fluid flow, but also to steam pressure. For this reason, with a high compression ratio in the screw press 22, a pressure difference can be maintained as between the screw press 22 and the fiberizer refiner 26. For example, 1.0 bar pressure (about 15 psig) can be maintained at the screw inlet 42, and 1.5 bar (about 22 psig) in the fiberizer refiner 26, as well as the condition discussed above, where the screw inlet 42 is maintained in the range of 5-30 psig and the fiberizer refiner 26 operates at atmospheric pressure. This option of operating at different pressures can be utilized as another means of optimizing the wood chip softening conditions during pretreatment.

In this regard, it should be appreciated that the softening of the wood chips at elevated temperature and pressure and associated high compression of the pretreatment subsystem 14 achieves only modest defibration. The main purpose of this portion of the pretreatment is to avoid damage to the fibers while the fibers experience one or both of partial fiberizing (under 25 percent), removal of extractives, and improved receptivity to the introduction of chemicals upstream of the fiberizer refiner 26. As noted above, the essence of the invention is achieving a high degree of fiberizing from about 30 percent to approaching 90 percent, without substantial fibrillation before introduction of the fiberized wood chips into a high intensity primary refiner 82.

It should be understood that the following examples are included for purposes of illustration so that the invention may be more readily understood and are in no way intended to limit the scope of the invention unless otherwise specifically indicated.

Example 1

FIGS. 6-13 graphically present the results of a pilot plant investigation of a pulp papermaking system as generally depicted in FIG. 1. The wood furnish used in the study was Black Spruce. The reference system utilized the RT Pressafiner pretreatment of the type described in International Application PCT/US98/14710, having the conditioning and compression at elevated temperature and pressure wherein less than 25 percent of the fibers are axially separated, whereupon these pretreated chips were fed to an RTS type primary refiner operating at 2300 rpm. This reference configuration is indicated as "RT-RTS".

The pilot system according to the present invention is represented by RTF-RTS, in which the preprocessing 12 and primary refining 16 were in the same equipment as for the reference RT-RTS runs. The number serving as the suffix to "RTF" indicates the speed of rotation of the fiberizing disc according to the invention. For both the reference runs and the runs according to the invention, the number in parentheses as a suffix to "RTS" indicates the primary refiner disc rotation speed.

Figure 6:
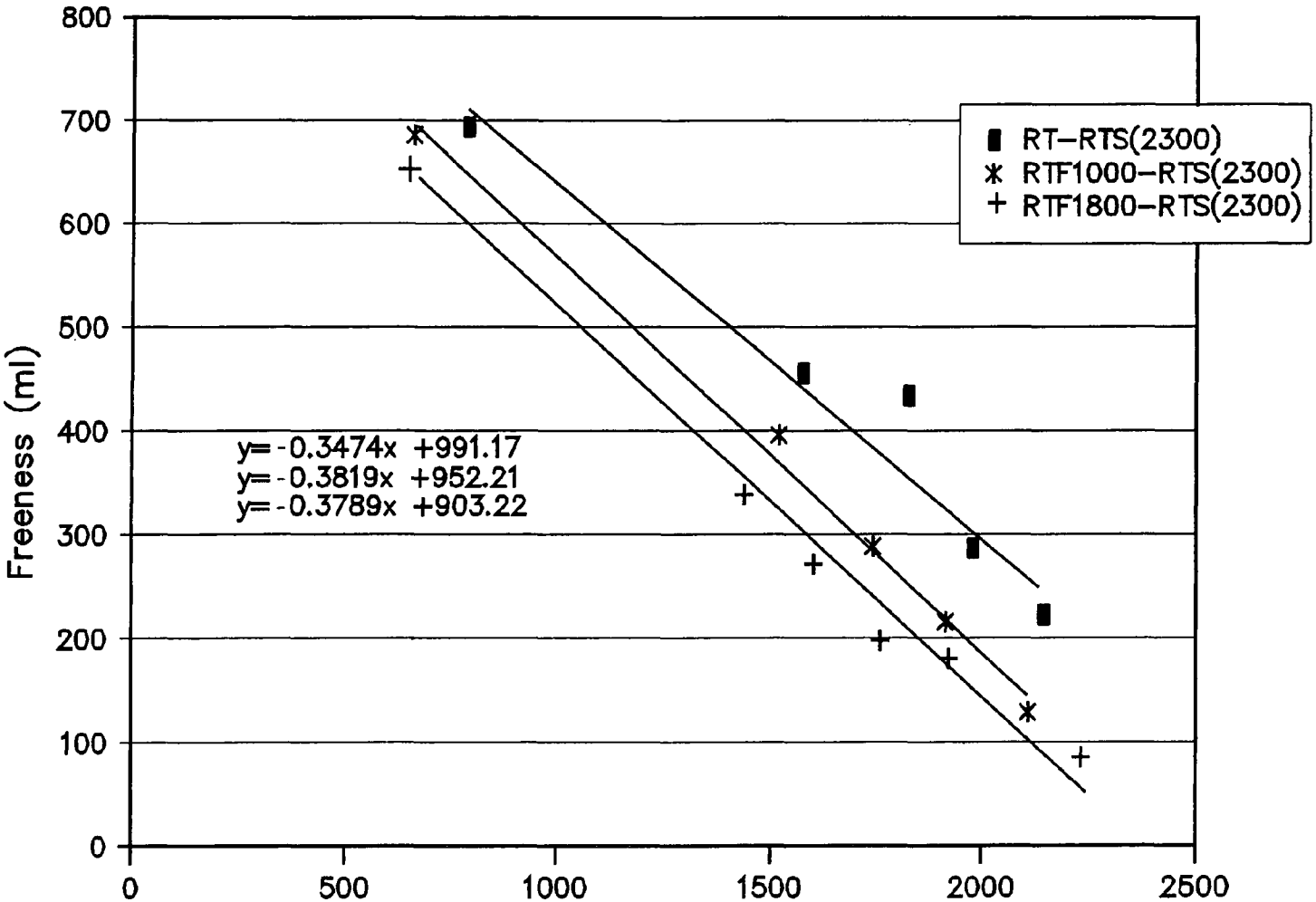
FIG. 6 is a graphic comparison of freeness vs. specific energy, between a reference RT-RTS process (RT Pressafiner pretreatment followed by RTS primary refining), and two variations of the inventive RTF-RTS process (RT Fiberizer pretreatment followed by RTS primary refining.

FIG. 6 is a graph showing freeness as a function of specific energy required to achieve that freeness for the reference run, a run according to the invention where the fiberizing refiner was operated at 1000 rpm, and a second run according to the invention where the fiberizing refiner was operated at 1800 rpm. It is clear from FIG. 6, that for any desired freeness, the required specific energy consumed to process feed material according to the invention is significantly less than the specific energy required to process feed material by the reference run. The specific energy values reported include the energy applied in the pretreatment and fibrillating refining stages.

Figure 7:
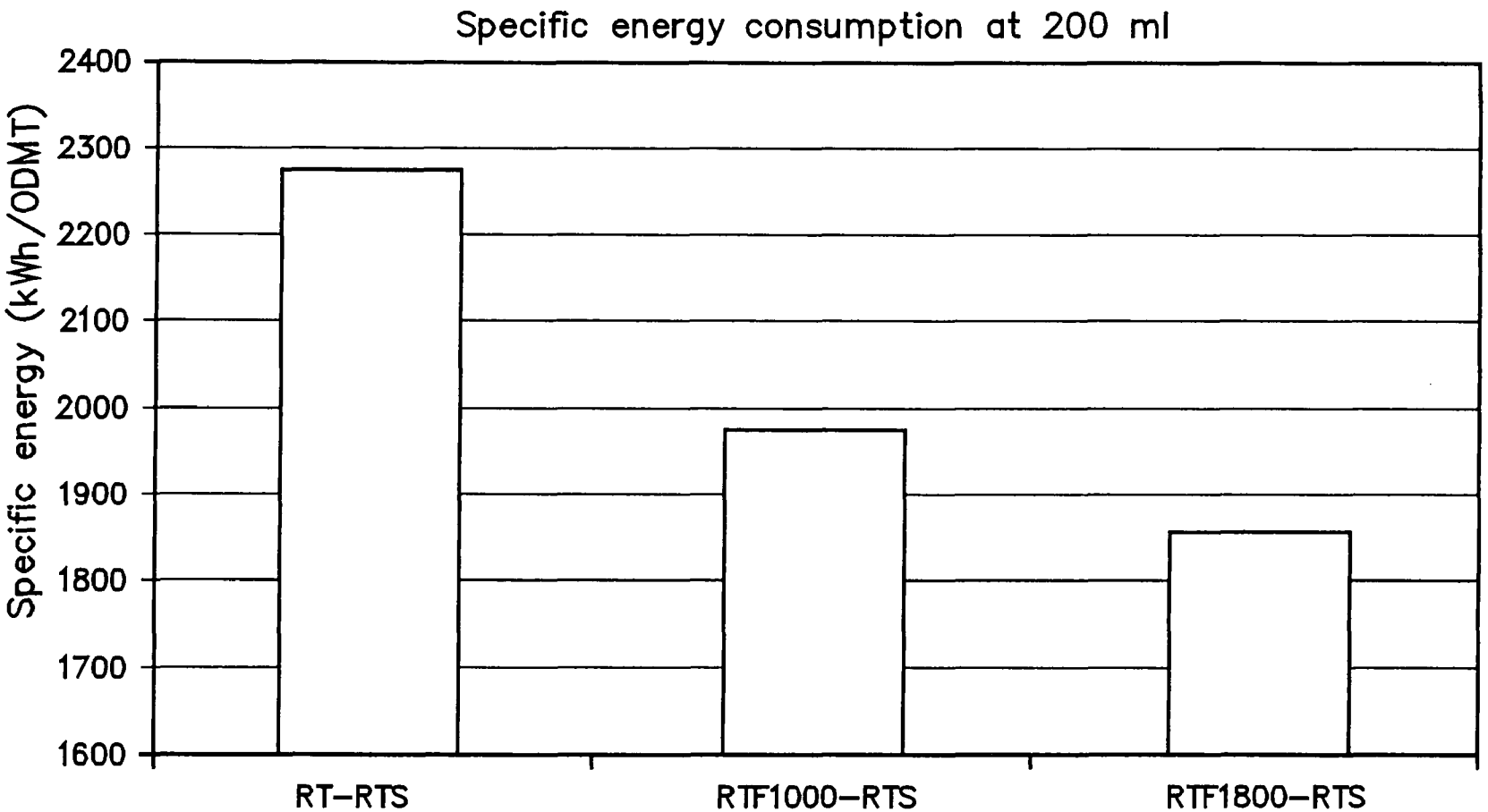
FIG. 7 is a bar graph representation of specific energy requirements for the three processes compared in FIGS. 6-8.

FIG. 7 shows in bar graph form a comparison of specific energy to achieve a freeness of 200 ml, according to the reference run and the two run variations according to the invention. The reference run consumed 2277 KWH/ODMT, the first run according to the invention consumed 1970 KWH/ODMT, and the second run according to the invention consumed 1856 KWH/ODMT. The percent energy reduction of the first run according to the invention was 13.5 percent relative to the reference run, and the energy reduction of the second run according to the invention was 18.5 percent relative to the reference run.

Figure 8:
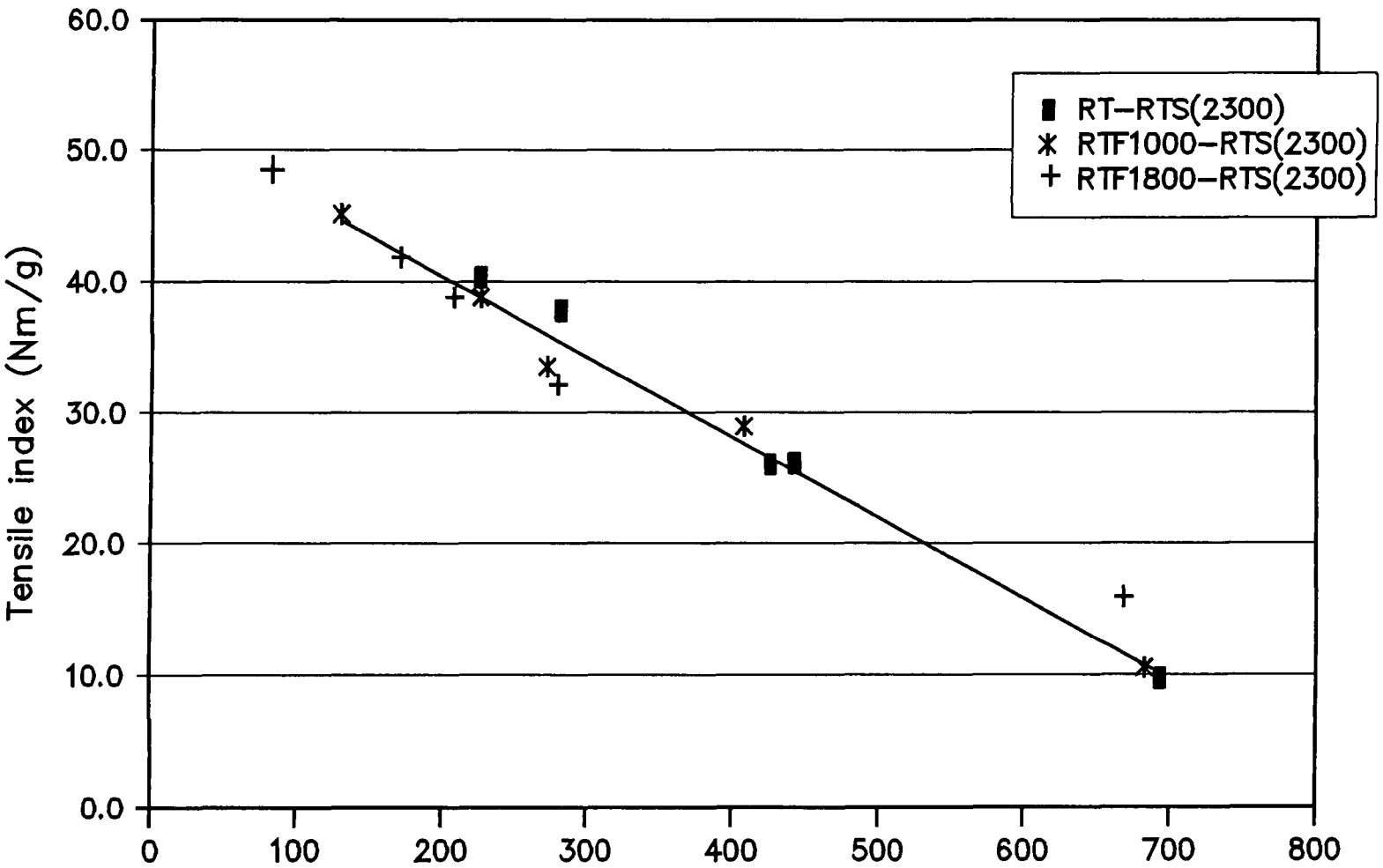
FIG. 8 is a comparison of the processes of FIG. 6 for tensile index vs. freeness.

FIG. 8 is a graph showing tensile index as a function of freeness for the same runs as represented in FIGS. 6 and 7. The results are presented following secondary refining. This relationship falls very close to a straight line, meaning that this relationship is substantially similar for the reference runs and the runs according to the invention.

Example 2

Figure 9:
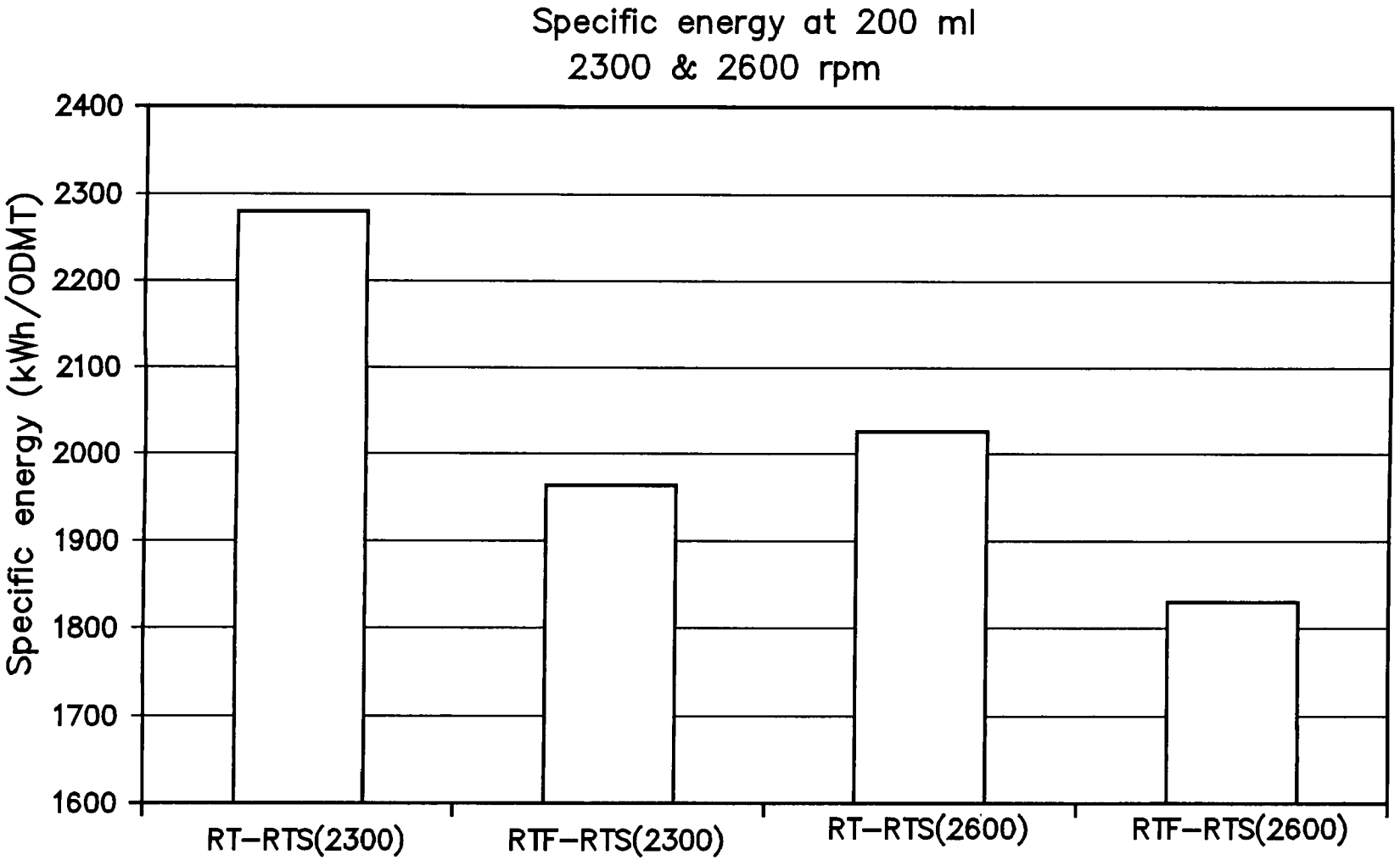
FIG. 9 is a bar graph comparison of the specific energy requirement to a freeness level of 200 ml, for the reference (RT-RTS) and inventive (RTF-RTS) processes, where the primary refiner is operated at two different speeds.

FIG. 9 is a bar graph showing a comparison of the effect on specific energy to achieve a freeness of 200 ml when the disc rotation speed on the high intensity, primary refiner is changed. The first bar is for the reference RT-RTS run with the primary refiner running at 2300 rpm, the required energy is 2277 KWH/ODMT. Implementation of the present invention for wood chip feed material pretreatment when processed further with the primary refiner running at 2300 rpm, required 1970 KWH/ODMT. With the reference RT-RTS running with a primary refiner at 2600 rpm, the required energy is 2023 KWH/ODMT, whereas when the inventive pretreatment is employed upstream of the primary refiner running at 2600 rpm, the required energy is 1830 KWH/ODMT. These data confirm that the beneficial effect of the pretreatment according to the invention can be realized over a range of high intensity primary refining speeds.

Figure 10:
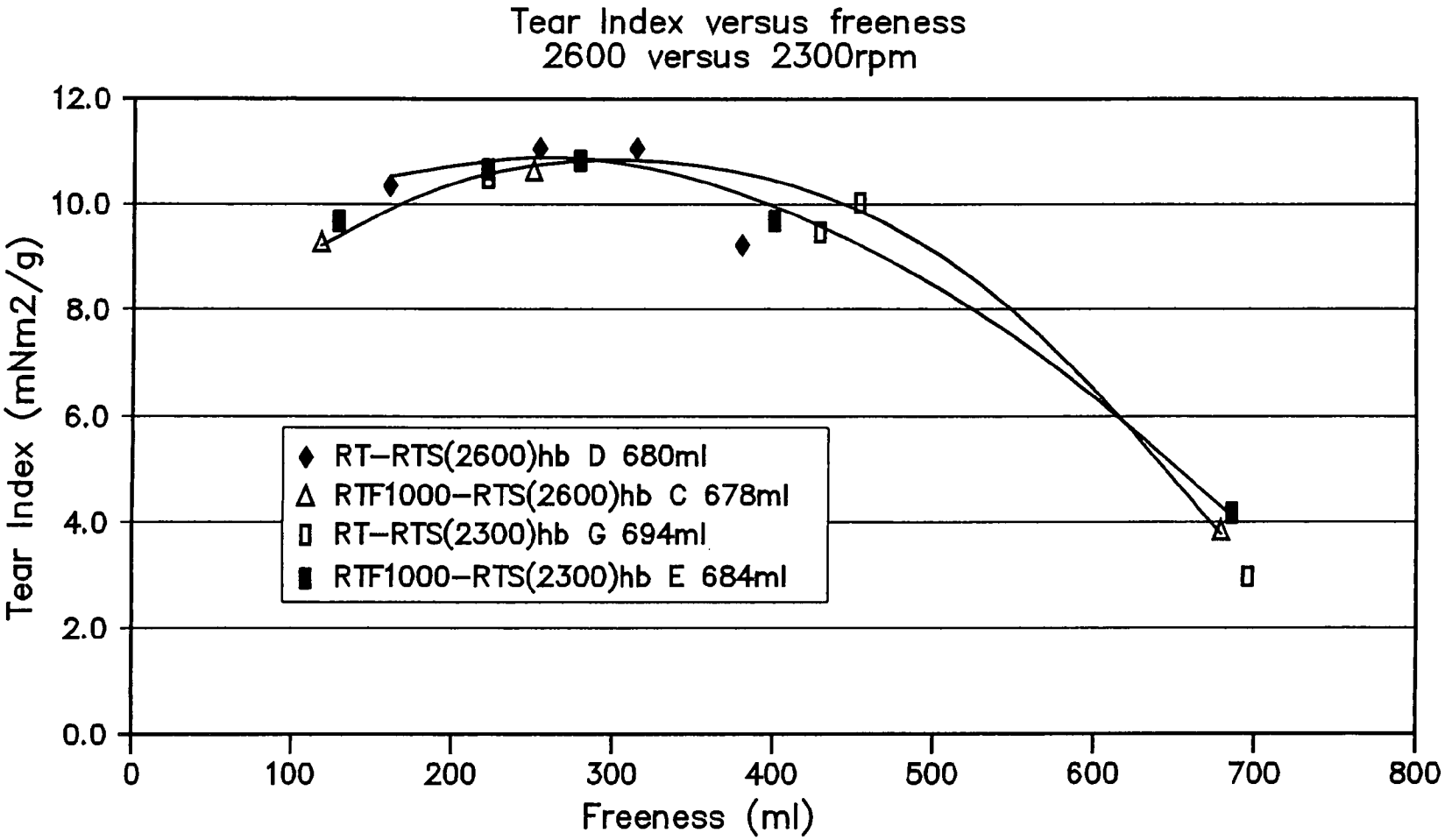
FIG. 10 illustrates tear index vs. freeness results for the reference and inventive processes of FIG. 9.

FIG. 10 compares the tear index results for the refiner series presented in FIG. 9. The tear results are presented following secondary refining, and the primary refiner freeness values are reported on the legend of FIG. 10. The tear index of the pulps produced according to the invention were maintained.

Example 3

Figure 11:
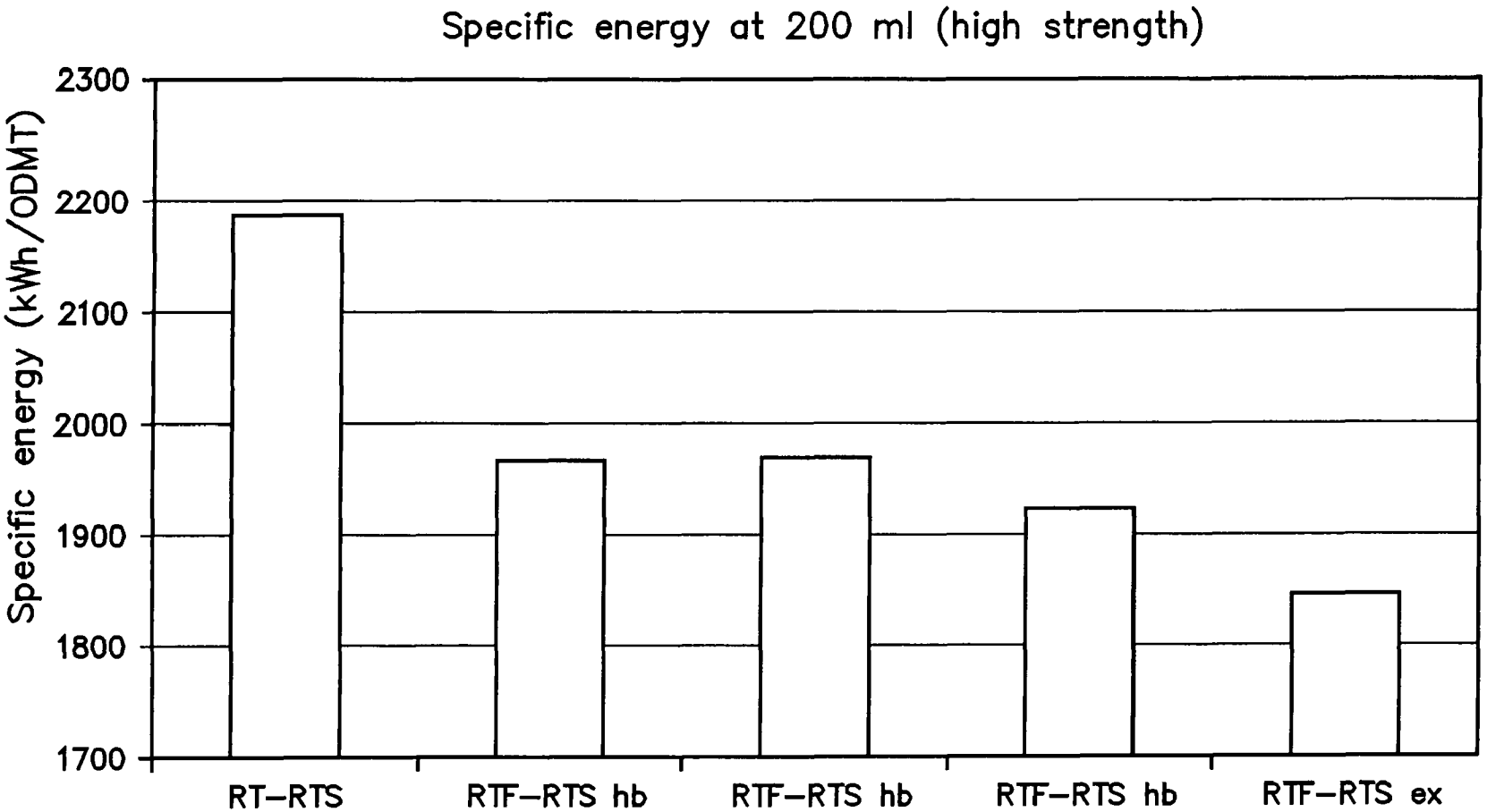
FIG. 11 is a graphic comparison of the specific energy for the reference (RT-RTS) and inventive (RTF-RTS) processes, wherein the effects of utilizing high intensity vs. low intensity refiner plates in the fiberizing disc are shown.

FIG. 11 represents results of a further investigation in which the specific energy applied to the fiberizer refiner was reduced by approximately 40%. The fiberizer disc speed for the pretreatment system was maintained at 1500 rpm and the high intensity primary refiner maintained at 2300 rpm, but with the plate pattern intensity in the primary refiner being varied. Referring to FIG. 11, the suffix (hb) refers to primary refiner plates operating in holdback direction (low intensity) and the suffix (ex) refers to primary refiner plates operating in expelling direction (high intensity). Each of the four refiner series produced according to the invention (RTF-) had a lower energy requirement than the reference (RT-), regardless of operating with low or high intensity plates. The pulps produced with the high intensity plates (ex) had the lowest energy requirements.

Figure 12:
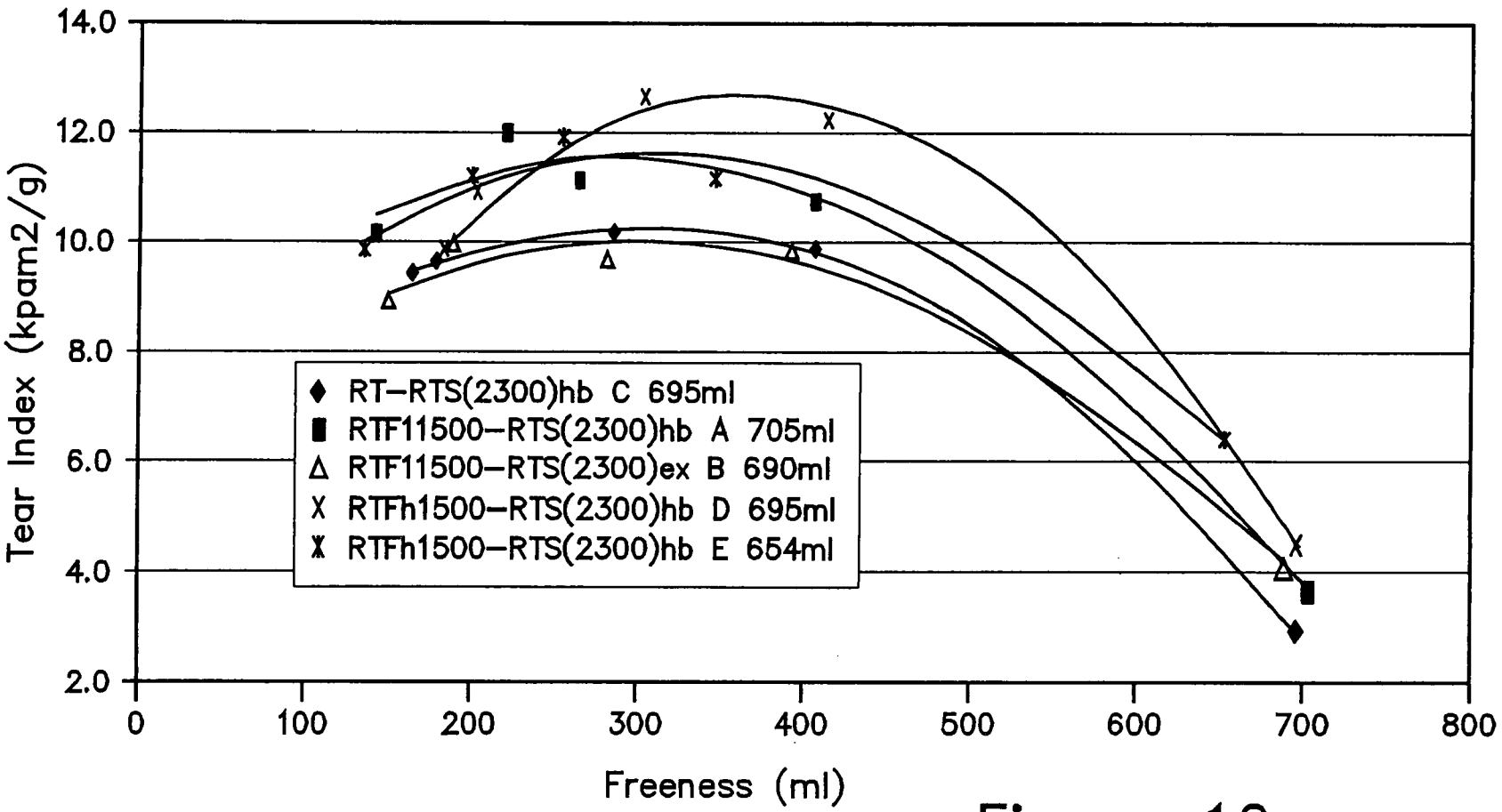
FIG. 12 illustrates tear index vs. freeness results for the reference and inventive processes of FIG. 11.

FIG. 12 compares the tear index results for the refiner series presented in FIG. 11. The three refiner series produced according to the invention (RTF) with low intensity primary refiner plates (hb) had a higher tear index than the reference pulps. The pulps produced with high intensity plates (ex) had a similar tear as the reference pulps.

Figure 13:
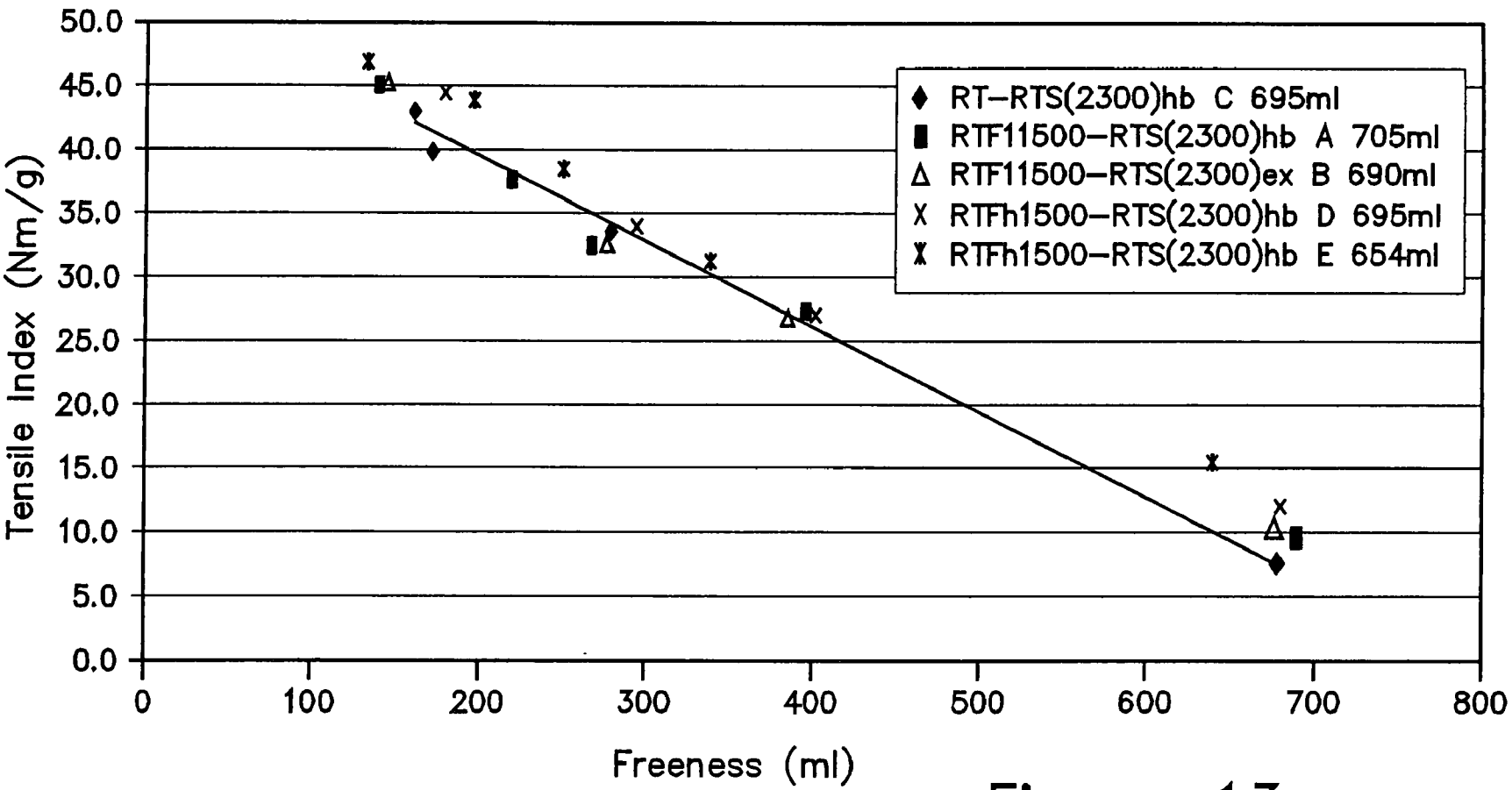
FIG. 13 illustrates tensile index vs. freeness results for the reference and inventive processes of FIG. 11.

FIG. 13 compares the tensile index results for the refiner series presented in FIG. 11. The tensile versus freeness relationship is similar for the reference pulp and pulps produced according to the invention.

The present invention was also found to be exceptionally effective for improving chemi-mechanical refining, e.g., with sulfite or alkaline peroxide addition. In particular, for a given amount of sulfite addition to the overall chemi-mechanical process, implementation of the invention with about half the chemicals introduced in the fiberizer device and about half in the regular primary refiner, gives better results than implementing the invention with all the chemicals introduced in the primary refiner. Good penetration of chemicals into the fiberized material during the controlled retention time before primary refining improves the reaction of the chemicals with the wood constituents. In this context, not only is the presence of a fiberizing device in the pretreatment stage a significant advance in the state of the art, but furthermore, the benefits are enhanced to an even greater extent with the introduction of chemical reagents in the fiberizing device, especially if there is a delay (retention time) between the fiberizer discharge and the primary refining. Impregnation of chemicals in the fiberized material improves the efficiency compared to impregnating wood chips or macerated chips, due to the higher exposed surface area of the fiberized material for chemical penetration.

Example 4

Effect of Combining RTF-Pretreatment with Chemical Agent

A study was conducted on a source of white spruce chips to evaluate the effect of combining extended chip defibration with an acid sulphate chemical treatment. A control RTF-RTS refiner series was initially produced. Two series were then produced with the chemical treatment applied at the fiberizer refiner. The first $RTF_c$-RTS series was produced with the fiberizer refiner pressurized at 1.5 bar and the latter series with the fiberizer refiner at atmospheric conditions. A final TMP series was produced for comparison at conventional refining conditions. The retention time and refining pressure for the TMP series was 3 minutes and 2.8 bar; the chips were destructured using RT-chip pretreatment prior to refining. Table 3 presents the specific energy consumption, tear index and tensile index results.

TABLE 3

| Process | Chemical Treatment | Pressure in Fiberizer (bar) | Tear Index ($mN \cdot m^2/g$) | Tensile Index (Nm/g) | Specific Energy (kWh/odmt) | % Change in Energy |
|---|---|---|---|---|---|---|
| RT-TMP | No | * | 8.5 | 49.2 | 2508 | +156 |
| RTF-RTS | No | 1.5 | 8.5 | 48.4 | 2169 | 0 (control) |
| $RTF_c$-RTS | Yes | 1.5 | 8.4 | 48.0 | 1990 | −8.3 |
| $RTF_c$-RTS | Yes | 0 | 7.7 | 44.9 | 1930 | −11.0 |

Properties interpolated at 100 ml.
* fiberizer not used for RT-TMP series.

Addition of the chemical treatment to the fiberizer refiner resulted in an energy reduction of approximately 8% compared to the control series. The chemical treatment did not impact pulp strength properties. An objective of chip fiberization is to improve the impregnation efficiency of chemithermomechanical pulping. Fiberized chips have more surfaces readily exposed for diffusion of chemicals into the wood structure, which can in turn improve the efficiency of wood impregnation.

The $RTF_c$-RTS refiner series produced with the fiberizer refiner at atmospheric conditions, 0 bar, had significantly lower strength properties. This was most likely a consequence of insufficient heating and softening during chip defibration, resulting in fiber breakage and lower long fiber content.

The RT-TMP refiner series had the highest specific energy requirements, approximately 16% higher than the control RTF-RTS series. The RT-TMP series required over 500 kWh/odmt additional energy compared to the $RTF_c$-RTS series produced at a similar freeness and pulp strength.

Example 5

Effect of Pretreatment Pressure on Pine Pulp Properties

A study was conducted to evaluate the importance of defibration temperature on red pine chips. Two RTF-RS series were produced at equivalent operating conditions, except defibration temperature. The first series was produced with the fiberizer operating at a pressure of 1.5 bar and the second with the fiberizer at atmospheric conditions. An application of 3.1% sulfite was applied to both series at the fiberizer refiner. Table 4 presents the results for the two refiner series.

TABLE 4

| Process | % Sulfite* | Pressure in Fiberizer (bar) | Tear Index ($mN \cdot m^2/g$) | Tensile Index (Nm/g) | Scattering Coefficient ($m^2/kg$) | +28 Mesh (%) |
|---|---|---|---|---|---|---|
| $RTF_c$-RTS | 3.1 | 1.5 | 7.1 | 36.7 | 58.6 | 33.3 |
| $RTF_c$-RTS | 3.1 | 0 | 4.8 | 28.6 | 61.5 | 22.5 |

Properties interpolated at 100 ml;
*pH of 9.4

The pine pulps produced with the fiberizer at atmospheric conditions had significantly lower long fiber content and strength properties. The red pine was therefore more sensitive to thermal heating during wood defibration than spruce.

The shive content of the material fiberized at 1.5 bar and 0 bar were 49.1% and 64.0%, respectively. Microscopic analysis of the fiberized chips produced at atmospheric conditions revealed considerable fiber breakage.

Example 6

Effect of Pretreatment on Alkaline Peroxide (AP) Thermomechanical Pulping

A study was conducted to evaluate the effect of the chip pretreatment on spruce AP-TMP pulp properties. Two AP-TMP refiner series were produced, with and without RTF-chip pretreatment. The primary refiner disc speed and operating pressure for both series were 2300 rpm and 2.8 bar, respectively. Table 5 presents the alkaline peroxide application levels and pulp property results for the two refiner series.

TABLE 5

| Process | % alkali* | % $H_2O_2$ | Tear Index ($mNm^2/g$) | Tensile Index (Nm/g) | +28 Mesh (%) | Scattering Coefficient ($m^2/kg$) | Brightness |
|---|---|---|---|---|---|---|---|
| AP-TMP | 3.8 | 4.9 | 7.9 | 50.1 | 30.7 | 43.9 | 80.2 |
| RTF AP-TMP | 3.4 | 4.1 | 10.0 | 49.9 | 40.6 | 50.8 | 77.7 |

Properties interpolated at 225 ml;
*net applied

The pretreated RTF AP-TMP pulps had approximately 2 $mNm^2/g$ higher tear index and 10% higher long fiber content. The tensile strength was similar for both series at a given freeness. The control AP-TMP series had 2.5 points higher brightness and lower scattering coefficient, mainly due to a higher application of alkaline peroxide. It is also noted the fiberizer refiner was operated at 1.5 bar. Operation of the fiberizer refiner at lower pressures and even atmospherically is advantageous for maximizing the bleaching response; such conditions are possible without strength degradation if the chips are partially impregnated in the chip press prior to fiberizing.

Results from this investigation show an increase in partially defibrated wood fibers can improve pulp strength properties and the efficiency of refining. The effect is presumed to be mostly a result of separating more latewood fibers, since this component is more easily defibrated in the early stages. The extent of earlywood defibration using the current method was not investigated.

Enhanced separation of the defibration and fibrillation steps appears to be a better approach than combining both mechanisms in a single refining stage. A separation strategy was presented that orients and defibrates fibers gently for maximizing fiber separation without breakage, followed by fibrillation at high-intensity conditions to minimize energy consumption.

Example 7

A pilot plant analysis was performed to compare the embodiment of the invention with and without sulfite addition on loblolly pine wood chips. The solution used was acid sulfite with a ph of 4.9. The low energy process configuration (RT Fiberizer) consisted of compressing and macerating the wood chips in a pressurized chip press, followed by fiberizing the wood chips in a disc refiner with approximately 120-130 kWh/MT applied. The operating pressure and disc speed of the defibrating refiner was 1.5 bar and 1800 rpm, respectively. The pretreatment process is designated by the prefix RTF. In this study, the effect of the new pretreatment was evaluated in combination with chemical pretreatment.

The fiberized chips were then refined in a pressurized 91 cm diameter single disc primary refiner (36-1CP) operating at RTS conditions. The retention time, pressure and disc speed were approximately 10 seconds, 5.2 bar, and 2300 rpm, respectively. A pressure of 5.2 bar was used instead of 6 bar in the primary refining stage because sulfite was added as a chemical treatment. This reduces the glass transition temperature of lignin, thereby decreasing the necessary refining pressure. The refiner plates used were Durametal 36604 operating in the feeding (expelling) direction to minimize energy consumption. The primary pulps were then secondary refined in the pressurized single disc refiner at a pressure of 2.8 bar and disc speed of 1800 rpm. The refiner plates used in the secondary position were Durametal 36604 operating in the holdback direction. Each secondary refined pulp was tertiary refined in an atmospheric double disc refiner (91 cm diameter) to lower freeness levels. A curve of three or four energy applications was applied in the tertiary refining stage.

Figure 14:
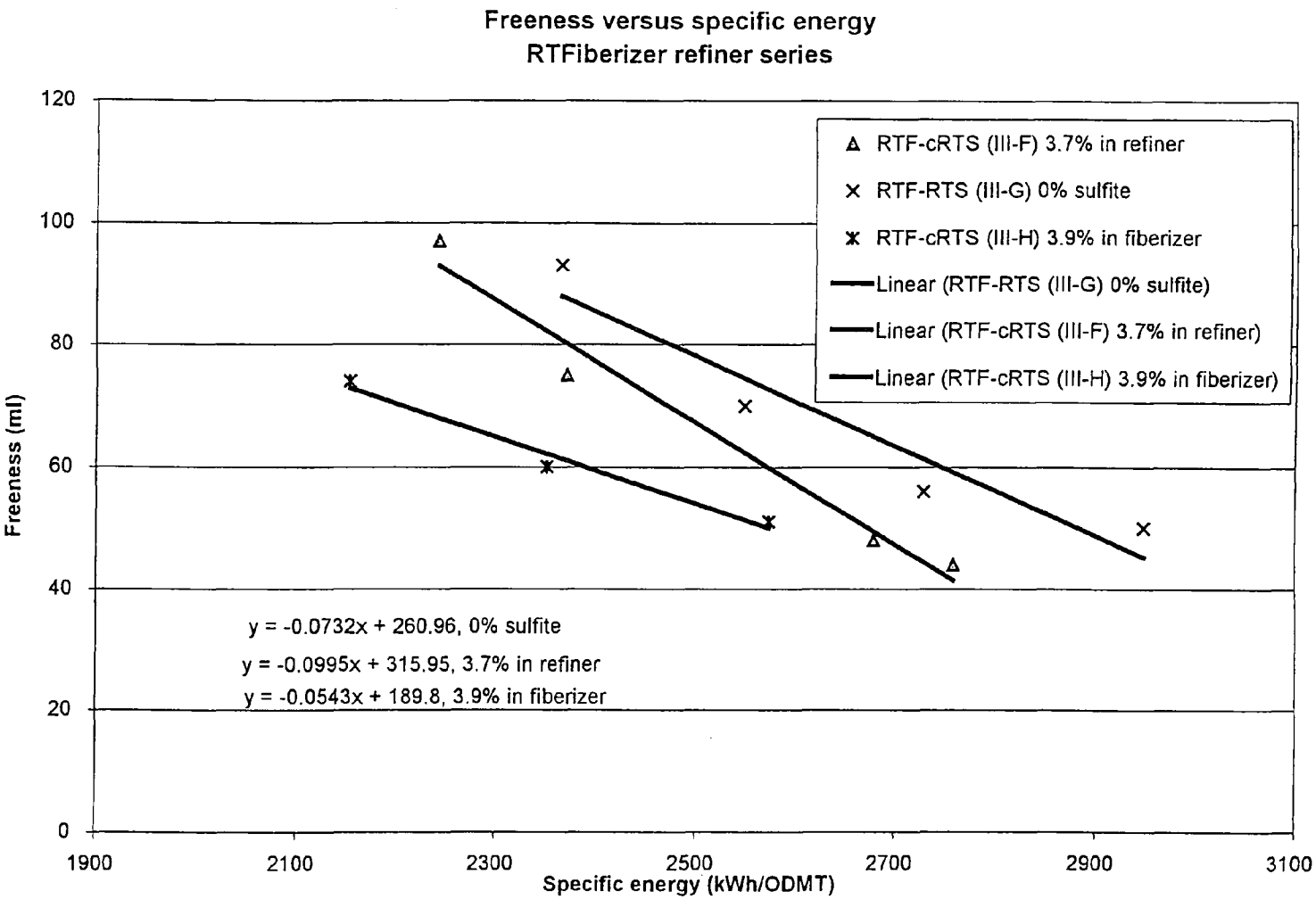
FIG. 14 is a graphic comparison of freeness vs. specific energy as dependent on where chemicals are introduced in the inventive process.
Figure 15:
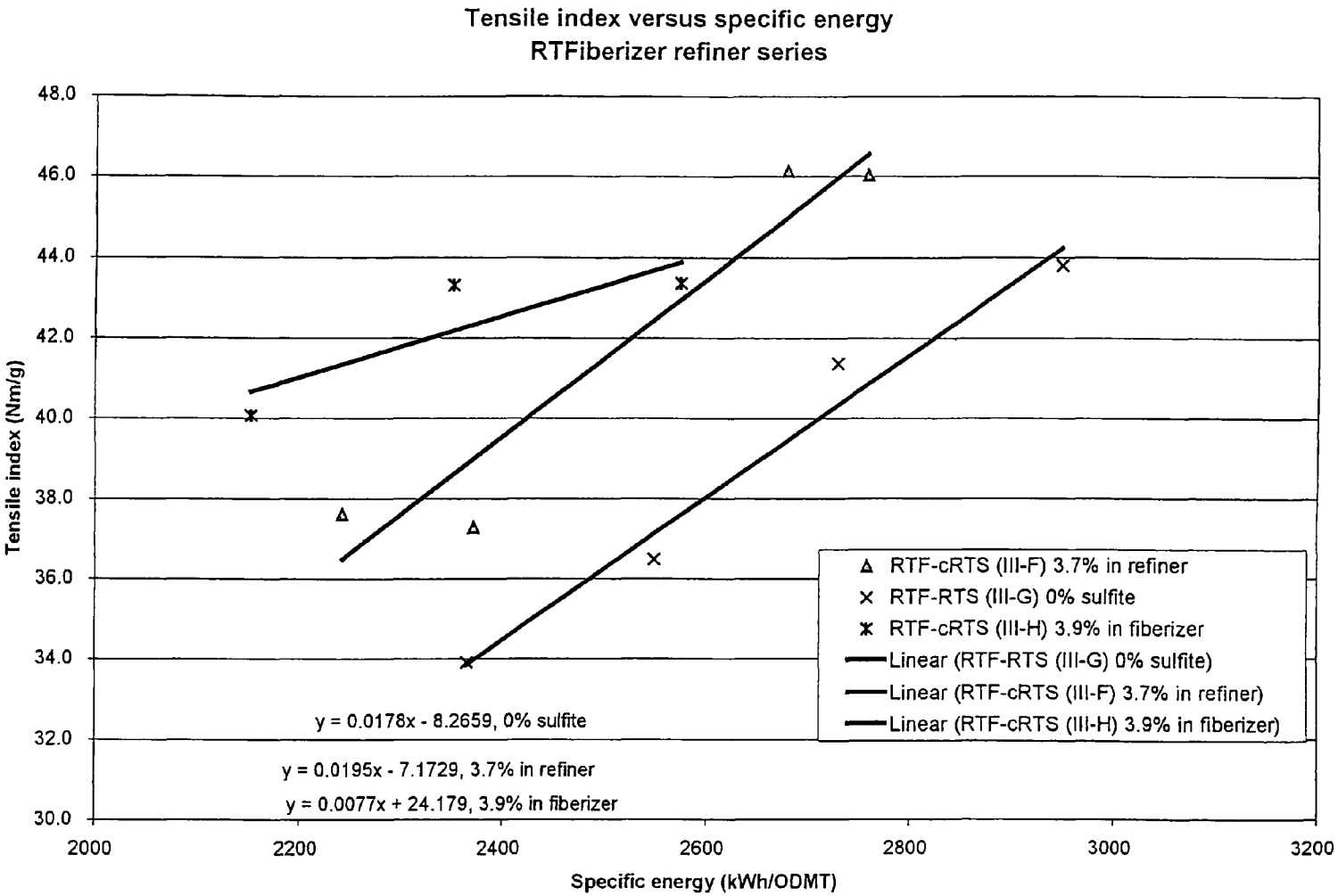
FIG. 15 is a graphic comparison of tensile index vs. specific energy as dependent on where chemicals are introduced in the inventive process.
Figure 16:
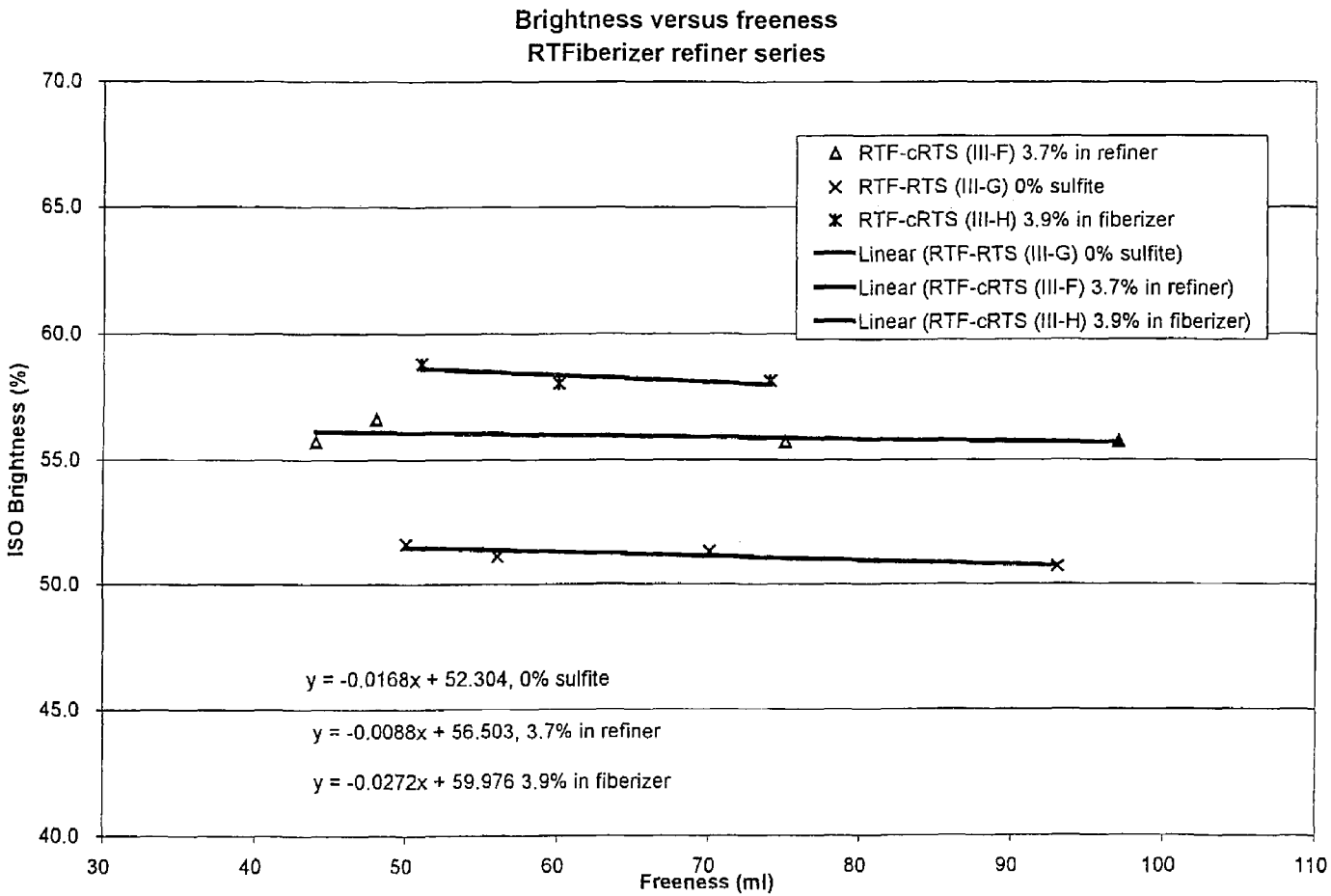
FIG. 16 is a comparison of brightness vs. freeness as dependent on where chemicals are introduced into the inventive process.

FIGS. 14-16 illustrate pulp properties and specific energy requirements for refiner series produced with and without sulfite treatment. The wood chips in each of the three series were processed using the RT Fiberizer method described above. The RTF prefix is used to designate the pretreatment according to the invention with a further designation of F, G, or H indicating the three series refined at similar levels of primary, secondary and tertiary specific energy. The nomenclature used in FIGS. 14-16 is as follows:

| Nomenclature | Acid Sulfite Addition |
|---|---|
| RTF-cRTS (III-F) 3.7% In Refiner | 2.1% Primary + 1.6% Secondary = 3.7% |
| RTF-RTS (III-G) 0% Sulfite | None |
| RTF-cRTS (III-H) 3.9% In Fiberizer | 2.0% (Fiberizer) + 0.9% Primary + 1.0% Secondary = 3.9% |

The "in refiner" designation refers to sulfite addition only at the refining stages. The "in fiberizer" designation refers to sulfite addition at both the initial defibrating (fiberizer) treatment and mainline (primary) refining.

The series H-runs, in which approximately 2% of the total 3.9% sulfite addition is in the fiberizer, have the lowest energy requirements (see FIG. 14), as well as having a higher tensile index compared with the series without any sulfite addition (series G). Similarly, the series H runs had the highest tensile index at a given applied energy (see FIG. 15). The series H runs also had the highest brightness at a given freeness (see FIG. 16), as well as the best scattering coefficient vs. freeness.

Example 8

Figure 17:
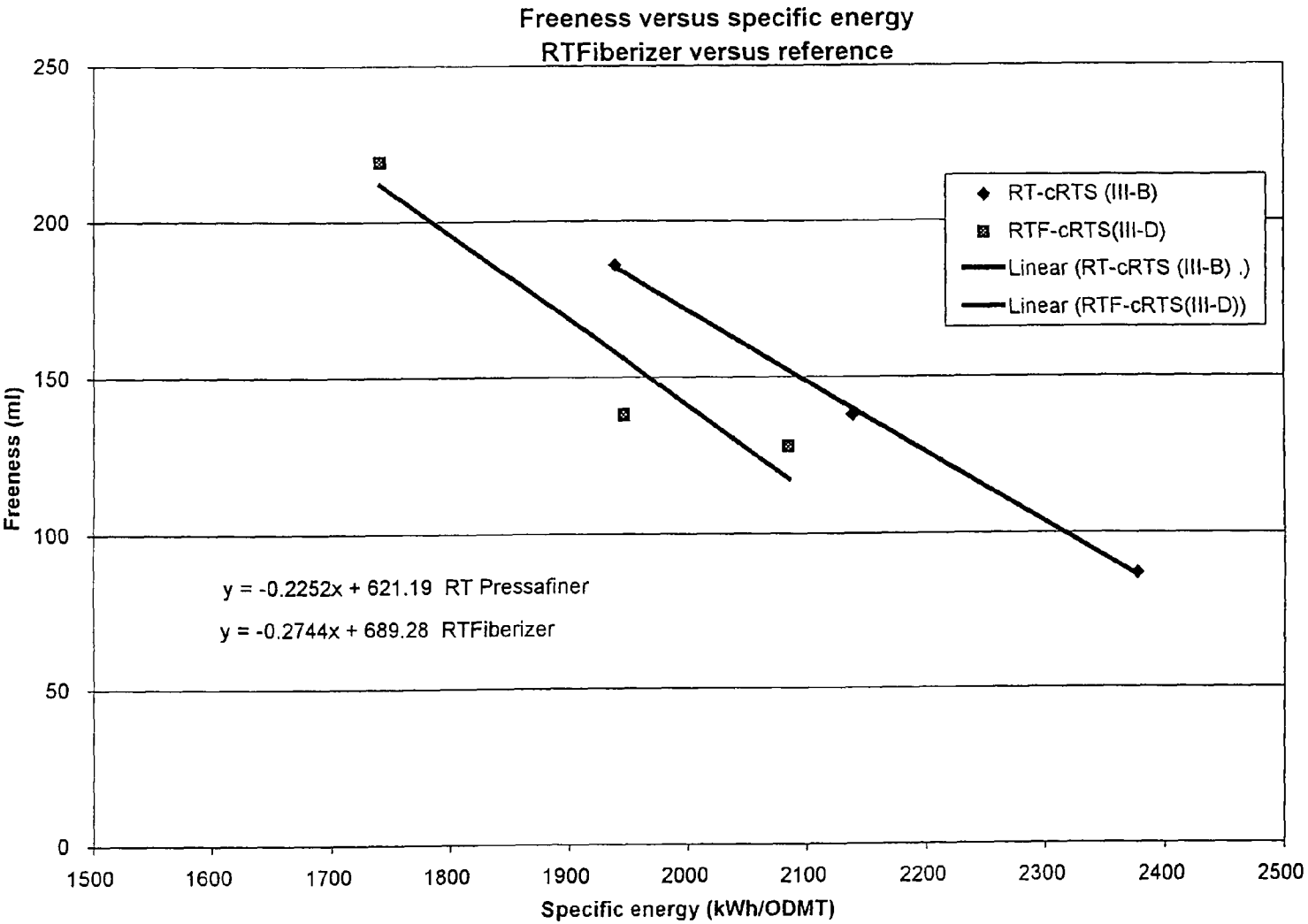
FIG. 17 is a graphic comparison of freeness vs. specific energy for selected chemi-mechanical pulps produced with pretreatment according to reference and inventive processes.
Figure 18:
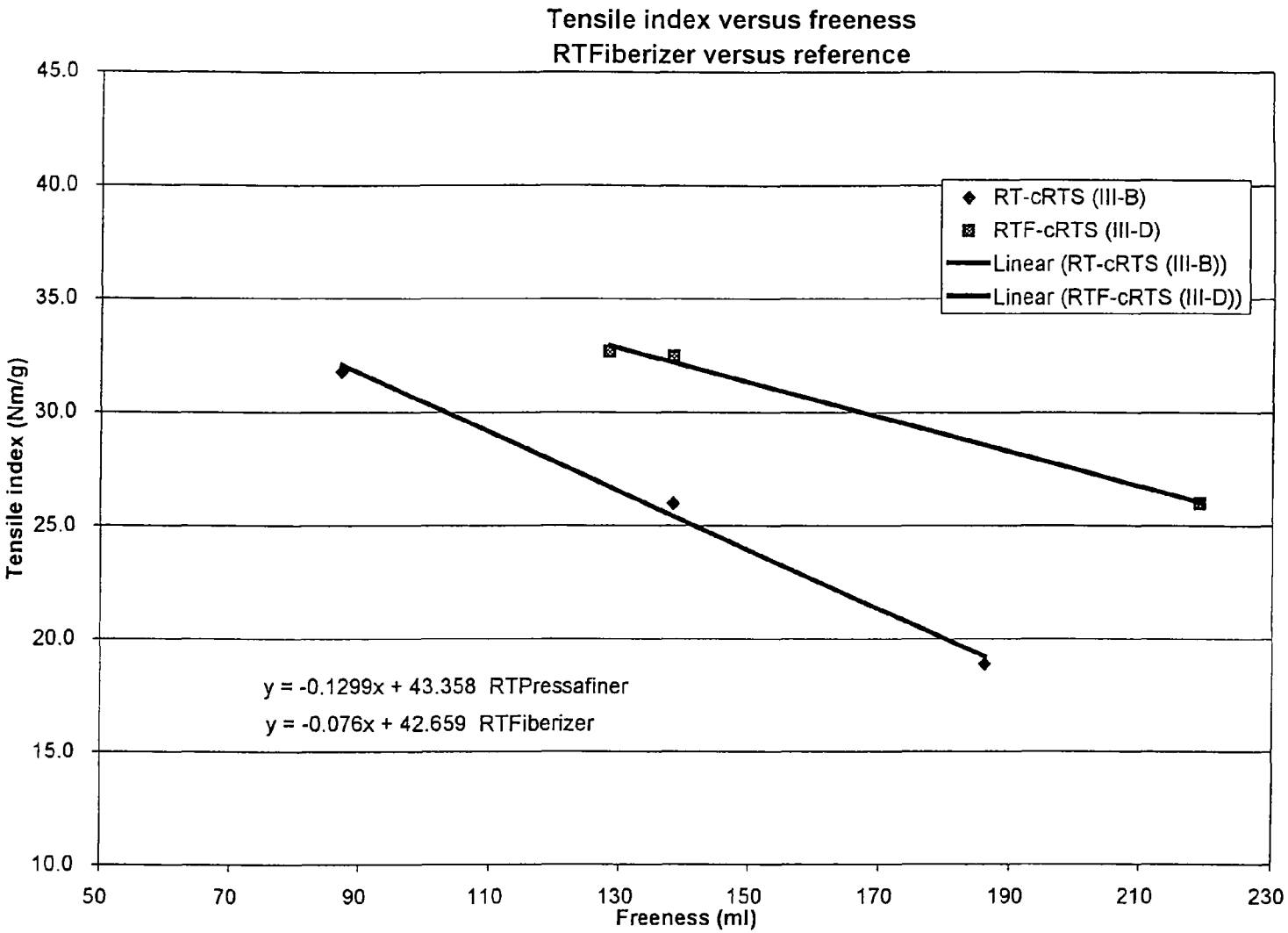
FIGS. 18-19 show the tensile index and tear index vs. freeness results for the reference and inventive processes of FIG. 17.
Figure 19:
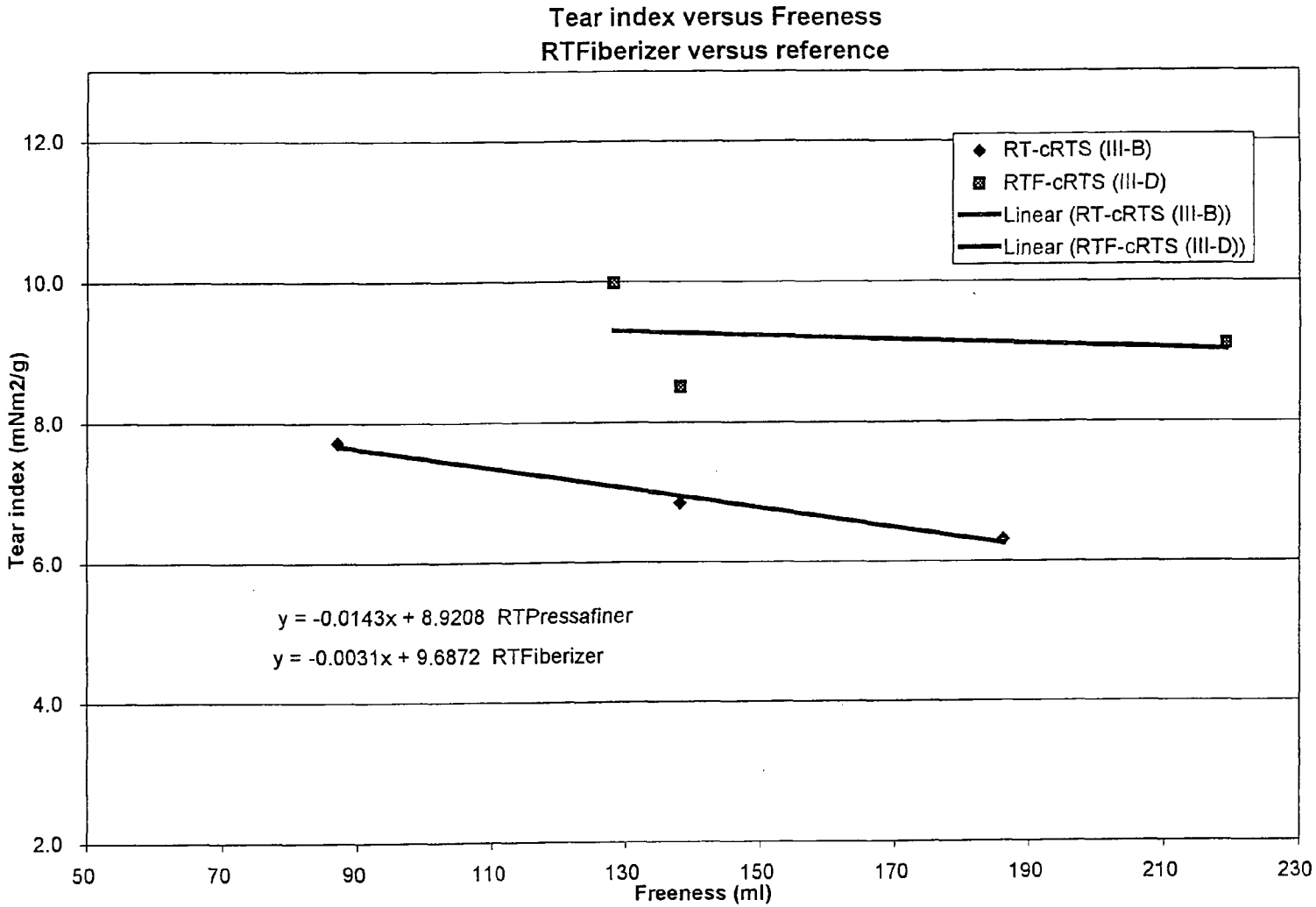

Comparisons were also made as between the present invention with chemical addition in the fiberizer, versus chemical addition in the refiner following the RT Pressafiner pretreatment according to International Patent Application No. PCT/US98/14710. These series were primary refined to the same freeness. FIGS. 17-19 illustrate the comparison of the RT-cRTS and RTF-cRTS refiner series. The nomenclature used in these figures is presented below:

| Nomenclature | Acid Sulfite Addition |
|---|---|
| RT-cRTS (III-B) | 2.3% Primary + 1.0% Secondary = 3.3% |
| RTF-cRTS (III-D) | 1.3% Fiberizer + 0.8% Pri. + 0.7% Sec. = 2.8% |

It can be appreciated that the pretreatment according to the invention had a lower energy consumption to a given freeness. The difference in energy consumption was approximately 200 KWH/MT at freeness of 150 ml. The RTF pretreated series also had a higher tensile index than the RT pretreated series had at a given freeness or specific energy (FIG. 18).

The RTF pretreated series also had a higher tear index compared to the RT pretreated series at a given freeness or tensile index (see FIG. 19). The brightness vs. freeness, scattering coefficient vs. tensile index and freeness and opacity vs. freeness were generally similar.

Figure 20:
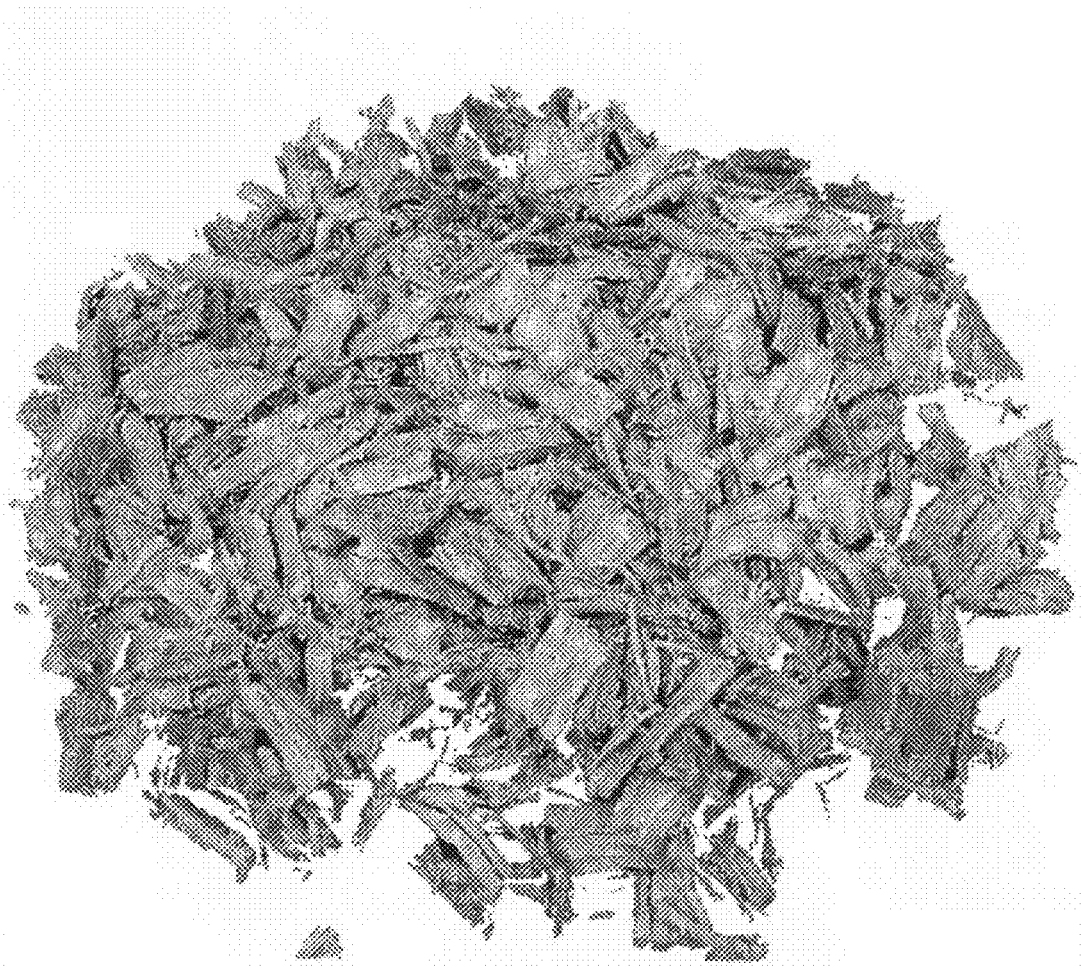
FIG. 20 is a photograph of chip material after pretreatment according to a known technique in which less than 25% of the fibers are axially separated.
Figure 21:
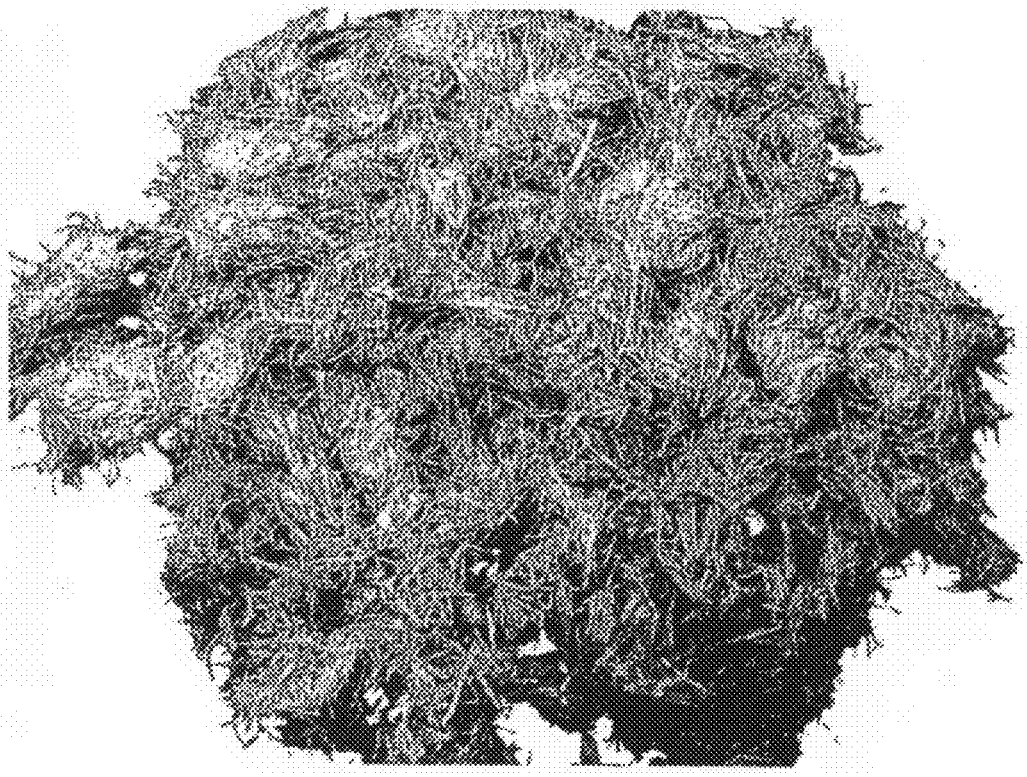
FIG. 21 is a photograph of the chip material after pretreatment according to the present invention, in which the material is resized with almost all the fibers axially separated.

FIGS. 20 and 21 are photographs showing, first, representative chips pretreated according to a prior technique that produces less than 25% fiber separation, and second, representative chips pretreated according to the invention. The inventive process produces a substantial resizing of the material, with almost all the fibers axially separated and appearing as short, grassy strands.

What is claimed:

1. Apparatus for pre-treating wood chip material comprising:

a pressure housing having an inlet at an inlet end and a discharge at a discharge end;

a screw press formed in the housing, wherein the screw press receives material from the housing inlet, and has a shaft that is rotatable about a screw shaft axis to convey and compress material along the screw axis toward the discharge end;

a decompression region for receiving and fully decompressing the chips from the screw press; and a refiner within the housing including a mechanical refining rotor having a rotor shaft that is co-axial with the screw shaft axis, and wherein the refiner receives material from the decompression region and fiberizes the material between one refining surface on the rotor and another refining surface spaced from the rotor within the housing before discharging from the discharge end, said screw shaft being joined to said rotor shaft.

2. The apparatus of claim 1, wherein the screw shaft rotates at a lower speed than rotor shaft.

3. The apparatus of claim 2, wherein the screw shaft rotates at a speed in the range of about 70-100 rpm and the rotor shaft operates at a speed in the range of about 800-1800 rpm.

4. The apparatus of claim 2, wherein the rotor shaft operates at a speed that is at least about ten times the screw shaft rotation speed.

5. The apparatus of claim 1, including a steam line in fluid communication with the housing, for maintaining the housing at a saturated steam pressure above about 5 psig.

6. The apparatus of claim 1, wherein said decompression region is also the inlet for the refiner.

7. The apparatus of claim 6, wherein a first motor drives the screw shaft and a second motor drives the rotor shaft.

8. The apparatus of claim 1, wherein the screw shaft has an extension portion that is joined to the rotor shaft in said region, the extension having means for conveying decompressed chips to the refiner.

9. The apparatus of claim 1, wherein the rotor is a disc.

10. The apparatus of claim 1, wherein the rotor is a cone.

11. The apparatus of claim 1, wherein the housing includes a refiner casing having a stationary plate defining said other refining surface.

12. The apparatus of claim 11, wherein the housing is maintained at a saturated steam pressure in the range of about 5-30 psig.

13. The apparatus of claim 12, wherein the screw shaft rotates at a speed in the range of about 70-100 rpm and the rotor shaft operates at a speed in the range of about 800-1800 rpm.

14. The apparatus of claim 1, wherein the screw shaft has an extension portion that is joined to the rotor shaft in said region, the extension having means for conveying decompressed chips to the refiner.

15. Apparatus for pre-treating wood chip material comprising:

a pressure housing having an inlet at an inlet end and a discharge at a discharge end;

a screw press formed in the housing, wherein the screw press receives material from the housing inlet, and has a shaft that is rotatable about a screw shaft axis to convey and compress material along the screw axis toward the discharge end;

a decompression region for receiving and fully decompressing the chips from the screw press; and a refiner within the housing including a mechanical refining rotor having a rotor shaft that is co-axial with the screw shaft axis, and wherein the refiner receives material from the decompression region and fiberizes the material between one refining surface on the rotor and another refining surface spaced from the rotor within the housing before discharging from the discharge end, said rotor shaft having an extension in said region, and means thereon for conveying material from the decompression region to the refiner.

16. The apparatus of claim 15, wherein a first motor drives the screw shaft and a second motor drives the rotor shaft.

17. The apparatus of claim 15, including a steam line in fluid communication with the housing, for maintaining the housing at a saturated steam pressure above about 5 psig.

18. The apparatus of claim 15, wherein the screw shaft rotates at a lower speed than the rotor shaft.

19. The apparatus of claim 15, wherein the housing includes a refiner casing having a stationary plate defining said other refining surface.

* * * * *